US009752355B2

(12) United States Patent
Nagaoka et al.

(10) Patent No.: US 9,752,355 B2
(45) Date of Patent: Sep. 5, 2017

(54) VEHICLE DOOR LATCH DEVICE

(71) Applicant: MITSUI KINZOKU ACT CORPORATION, Yokohama-shi (JP)

(72) Inventors: Tomoharu Nagaoka, Yokohama (JP); Hideaki Nozawa, Yokohama (JP)

(73) Assignee: MITSUI KINZOKU ACT CORPORATION (JP)

( * ) Notice: Subject to any disclaimer, the term of this patent is extended or adjusted under 35 U.S.C. 154(b) by 415 days.

(21) Appl. No.: 14/255,159

(22) Filed: Apr. 17, 2014

(65) Prior Publication Data

US 2014/0312632 A1 Oct. 23, 2014

(30) Foreign Application Priority Data

| | | |
|---|---|---|
| Apr. 23, 2013 | (JP) | 2013-090600 |
| Jun. 7, 2013 | (JP) | 2013-120581 |
| Jun. 17, 2013 | (JP) | 2013-126907 |
| Jun. 20, 2013 | (JP) | 2013-129189 |
| Jun. 20, 2013 | (JP) | 2013-129515 |

(51) Int. Cl.
*E05B 79/08* (2014.01)
*E05B 77/04* (2014.01)

(52) U.S. Cl.
CPC ..... *E05B 79/08* (2013.01); *E05B 77/04* (2013.01); *Y10T 292/108* (2015.04)

(58) Field of Classification Search
CPC ..... E05B 79/08; E05B 79/10; E05B 79/12; E05B 79/22; E05B 77/02; E05B 77/04; E05B 77/08
USPC ..... 292/201, 216, 217, 200, DIG. 23, 292/DIG. 22, DIG. 65
See application file for complete search history.

(56) References Cited

U.S. PATENT DOCUMENTS

| | | | | |
|---|---|---|---|---|
| 4,995,654 | A * | 2/1991 | Nishigami | E05B 77/12 292/216 |
| 5,813,709 | A * | 9/1998 | Umino | E05B 83/36 292/216 |
| 8,128,151 | B2 | 3/2012 | Teramoto et al. | |
| 8,303,004 | B2 * | 11/2012 | Lee | E05B 77/06 292/216 |
| 8,353,542 | B2 * | 1/2013 | Cumbo | E05B 77/06 292/196 |
| 9,366,063 | B2 * | 6/2016 | Rosales | E05B 77/06 |

(Continued)

FOREIGN PATENT DOCUMENTS

| | | |
|---|---|---|
| JP | 60-55671 B2 | 12/1985 |
| JP | 2011-58351 A | 3/2011 |

*Primary Examiner* — Alyson M Merlino
(74) *Attorney, Agent, or Firm* — Ostrolenk Faber LLP

(57) ABSTRACT

In a vehicle door latch device, a first outside lever is pivotally mounted via a pivot shaft, and second outside lever is connected to an outside handle on an outer panel of a door via a motion-transmitting member to move toward the inside of a vehicle. Usually, turning of the second outside lever for disengaging a latch from a striker is transmitted to the first outside lever. If the second outside lever is impacted by an external force, the outer panel is deformed to move the second outside lever inward of the vehicle with respect to the first outside lever. But release turning of the second outside lever cannot be transmitted to the first outside lever. Even if the door is deformed by the external force, the door is still closed.

2 Claims, 40 Drawing Sheets

(56) References Cited

U.S. PATENT DOCUMENTS

| | | | | |
|---|---|---|---|---|
| 2004/0046400 | A1* | 3/2004 | Drysdale | E05B 77/06 292/216 |
| 2009/0001734 | A1* | 1/2009 | Akahori | E05B 77/04 292/216 |
| 2013/0056997 | A1* | 3/2013 | Mittelbach | E05B 77/06 292/198 |
| 2013/0147209 | A1* | 6/2013 | Lee | E05B 77/06 292/57 |
| 2013/0147211 | A1* | 6/2013 | Lee | E05B 77/06 292/198 |
| 2013/0313036 | A1* | 11/2013 | Kovie | E05B 77/06 180/274 |
| 2014/0284940 | A1* | 9/2014 | Rosales | E05B 77/04 292/92 |
| 2014/0284943 | A1* | 9/2014 | Wittelsbuerger | E05B 77/06 292/92 |

* cited by examiner

VEHICLE DOOR LATCH DEVICE

BACKGROUND OF THE INVENTION

The present invention relates to a door latch device provided in a door of a vehicle, and particularly to a vehicle door latch device in which a door is still closed even if an outer panel of the door is deformed by impact.

A vehicle door latch device comprises a base member fixed in a door; a latch supported on the base member to engage with a striker of a vehicle body; a ratchet which engages with the latch to prevent the latch from turning; an outside lever pivotally mounted to the base member about a pivot shaft extending longitudinally of the vehicle for transmitting motion of an outside handle via a motion-transmitting member when the door is opened; and various levers for turning the ratchet in a releasing direction for disengaging from the latch.

In the door latch device, the outside lever is connected to the outside handle on an outer panel of the door. Thus, the motion-transmitting member and a connecting portion connected to the lower end of the motion-transmitting member project from the side edge toward the outer panel outward of the vehicle, The outer panel is deformed inward of the vehicle by impact, and the outer panel can come in contact with the connecting portion or motion-transmitting member through the deformation. The outside lever turns in a releasing direction for opening the door, and the door is likely to open accidentally. It is necessary to make a space between the outer panel and door latch device broader, but a room space of the vehicle becomes smaller.

In view of the disadvantage in the prior art, JP60-55671 B2 and U.S. Pat. No. 8,128,151B2 disclose a door latch device or a door lock device in which a door is still closed even if an outer panel is deformed by impact thereby preventing the door from opening accidentally.

The door lock device in JP60-55671B2 comprises a lift lever connected to an operating handle to lock and unlock the door; a resilient member supporting the lift lever to be inclinable; and a projection which comes in contact with the lift lever at inclination of the lift lever to prevent the lift lever from turning when the lift lever is inclined. By impact, an external force caused by door deformation acts to the lift lever, and the lift lever moves to a position where it contacts the projection via the resilient member thereby preventing the lift lever from turning in a lock-releasing direction to hold the door closed, but there is a problems as below.

The lift lever is elastically supported in the middle by a shaft and a compression spring around the shaft. A supporting force of the lift lever is likely to become weaker due to aging deterioration of the resilient member and sliding wear of the resilient member with the head of the shaft. By vibration, the lift lever is loose about the middle in a thickness direction during turning, and the extended end of the lift lever is likely to go away from the end of a pole actuated by turning the lift lever, which lacks reliability. Furthermore, when a turning force acts to the lift lever, it is not possible to prevent the lift lever from turning, which is disadvantageous.

In the door latch system in U.S. Pat. No. 8,128,151B, if the door latch system is moved inward of the vehicle through inward deformation of the outer panel of the door, the drive rod connected to the door handle and the latch-release unit of the door latch system comes in contact with the drive rod striking member mounted on the inner panel and is moved outward of the vehicle, thereby disengaging the drive rod from the latch release unit, so that the door is still closed. However, when the door latch system is moved inward of the vehicle due to inward deformation of the outer panel close to the door latch system, the drive unit is disengaged from the latch release unit effectively, which is advantageous. But it is difficult to set the drive rod striking member in position, which is unreliable as a door lock device.

It is necessary to provide the drive rod striking member, and there is a problem in layout in the door.

SUMMARY OF THE INVENTION

In view of the disadvantages in the prior art, it is an object of the invention to provide a vehicle door latch device in which a door is still closed even if the door is deformed, providing high reliability.

BRIEF DESCRIPTION OF THE DRAWINGS

The features and advantage of the present invention will become clear with the following description of embodiments as shown in accompanying drawings as below.

DETAILED DESCRIPTION OF PREFERRED EMBODIMENTS

Figure 1:
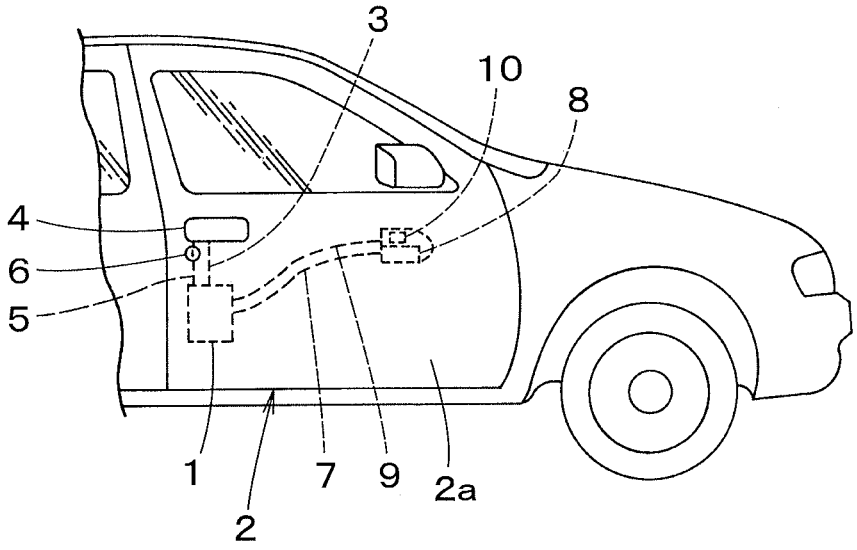
FIG. 1 is a right-side view of a front half of a vehicle comprising a first embodiment of a door latch device according to the present invention.

A first embodiment of a door latch device according to the present invention will be described with respect to FIGS. 1 to 9. In the following description, left and right sides are deemed as "inside" and "outside" of a motor vehicle respectively in FIGS. 2 and 3. The door latch device according to the present invention is mounted at the rear end inside right and left front doors of the motor vehicle, and in the embodiment, the door latch device 1 is mounted in the right front door 2 in FIG. 1.

The door 2 comprises an outer panel 2*a* and an inner panel (not shown). There are provided an outside handle 4 for operating the door latch device 1 to open the door via a motion-transmitting member 3 from the outside of the motor vehicle, and a key cylinder 6 for unlocking/locking the door latch device 1 via a motion-transmitting member 5 from the outside of the motor vehicle at an upper rear part on the outer side surface of the outer panel 2*a*. There are provided an inside handle 8 for operating the door latch device 1 to open the door from the inside of the motor vehicle via a motion-transmitting member 7, and a lock knob 10 for unlocking/locking the door latch device 1 via a motion-transmitting member 9 from the inside of the motor vehicle on the inner front surface of the inner panel.

Figure 2:
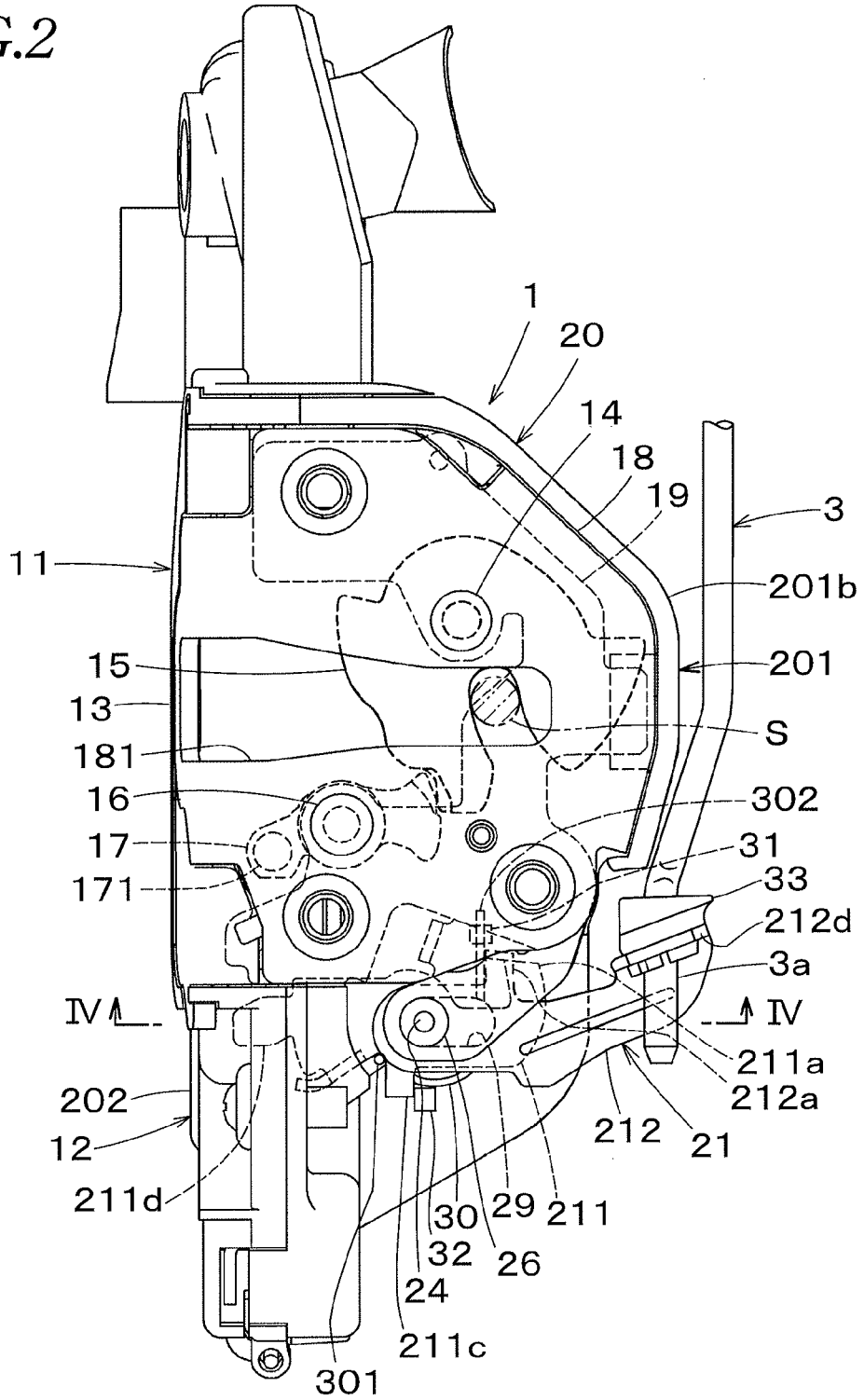
FIG. 2 is a front elevational view of the same viewed from the back of the vehicle.
Figure 3:
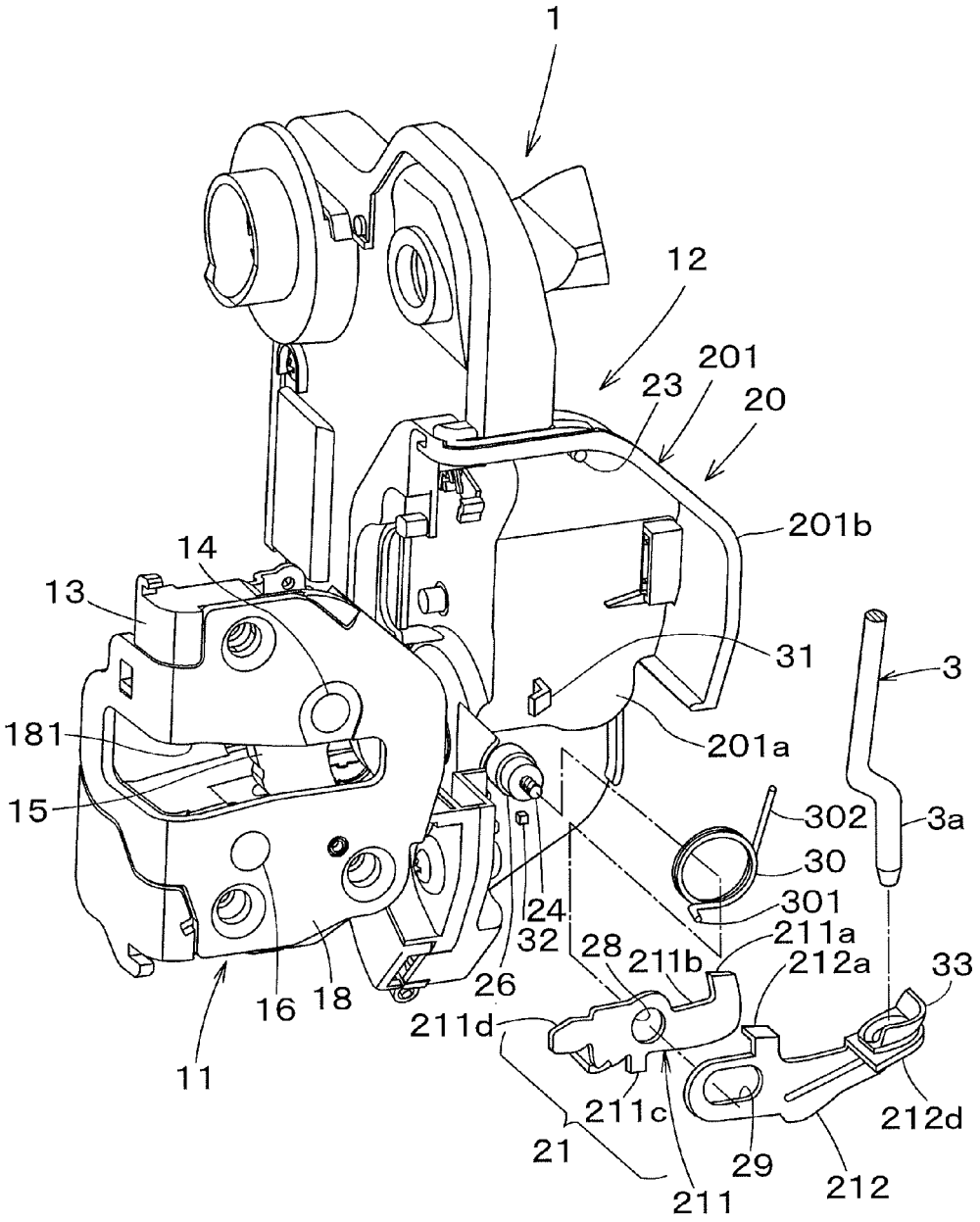
FIG. 3 is an exploded perspective view of the same.

In FIGS. 2 and 3, the door latch device 1 comprises an engagement portion 11 which engages with a striker S of a vehicle body to hold the door 2 closed, and an operating portion 12 for operating the engagement portion 11.

The engagement portion 11 comprises a synthetic resin body 13 fixed to the rear end of the door 2 in the door 2; a latch 15 engagable with the striker S of the vehicle body; a ratchet 17 pivotally mounted on a ratchet shaft 16 to engage with the latch 15 in the body 13; a ratchet pin 171 disposed on the back side (or the front side when the door latch device 1 is mounted to the door 2) of the body 13 and formed on the ratchet 17; a metal cover member 18 closing the front side (or the back side when the door latch device 1 is mounted to the door 2) of the body 13; and a metal back member 19 fixed to the back side of the body 13.

When the door 2 is closed, the striker S of the vehicle body enters a striker-engagement groove 181 in the middle of the cover member 18 and engages with the latch 15. The ratchet 17 engages with the latch 15 to prevent the latch 15 from turning in an opening direction (or clockwise in FIGS. 2 and 3) so as to hold the door 2 closed.

The operating portion 12 comprises a synthetic-resin casing 20 as a base member fixed to the back side of the body 13 via the back member 19; various levers connected in the casing 20; a connecting lever and a motor (not shown).

The various levers in the casing 20 include an outside lever 21 connected to the outside handle 4 via the motion-transmitting member 3; an inside lever (not shown) connected to the inside handle 8 of the door 2 via the motion-transmitting member 7 and actuated by the inside handle 8; a locking lever (not shown) connected to the lock knob 10 via the motion-transmitting member 9 and actuated by the lock knob 10, and a key lever (not shown) connected to the key cylinder 6 via the motion-transmitting member 5 and actuated by the key cylinder.

The connecting lever includes a release lever 43 connected to an inner end 211*d* of a first outside lever 211 of the outside lever 21 to move an unlocking position and a locking position with the locking lever. When the release lever 43 is in the unlocking position, the release lever 43 moves up with releasing action of the first outside lever 211 by actuating the outside handle 4 to enable the releasing action to be transmitted to the ratchet 17 to disengage the ratchet 17 from the latch 15 thereby enabling the door 2 to open. The inside lever, locking lever, key lever and release lever 43 except the outside lever 21 are known in a conventional door latch device, and detailed description about the structure and connection between the levers is omitted.

When the engagement portion 11 is connected to the operating portion 12, the casing 20 comprises a first casing 201 fixed to the back side of the engagement portion 11 via the back member 19 at the back side of the body 13; and a second casing 202 perpendicular to the first casing 201. The various levers except the outside lever 21 are disposed in the second casing 202. The first casing 201 comprises a base 201*a* which faces the body 13 and an upper side wall 201*b* projecting backward from the upper part of the base 201*a* over the upper half of the body 13.

Figure 4:
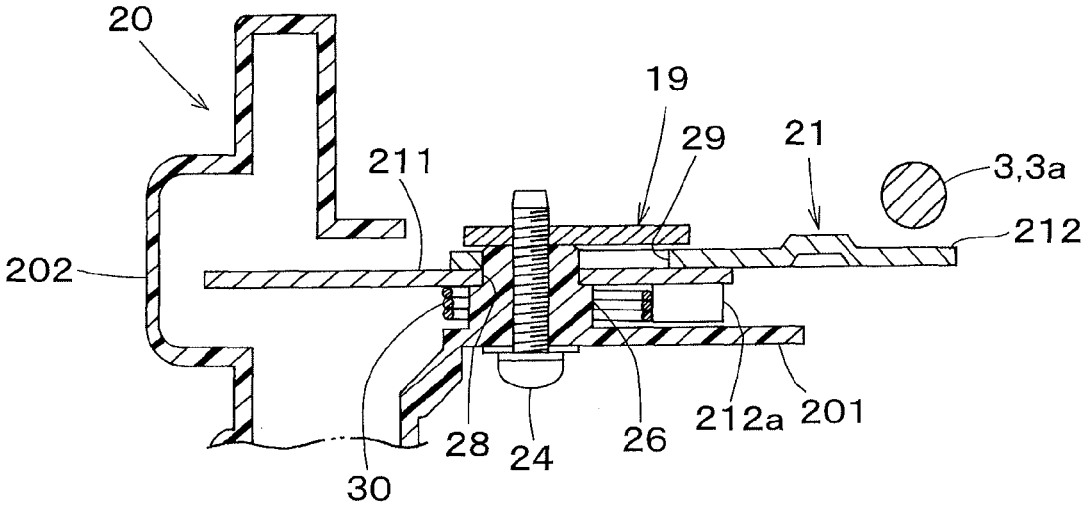
FIG. 4 is a horizontal sectional view taken along the line IV-IV in FIG. 2.

In order that the engagement portion 11 may be firmly connected to the operating portion 12, upper and lower parts of the casing 20 are joined to the back member 19 with bolts 23,24. In FIG. 4, the lower bolt 24 passes through a center of a pivot shaft 26 which projects from a rear surface of the first casing 201, and engages in the back member 19.

The latch 15 and ratchet 17 in this embodiment constitute the engagement portion in this invention; the body 13 or casing 20 correspond to the base member in this invention; and the body 20, cover member 18 and/or back plate 19 correspond to a stationary member in this invention.

Figure 5:
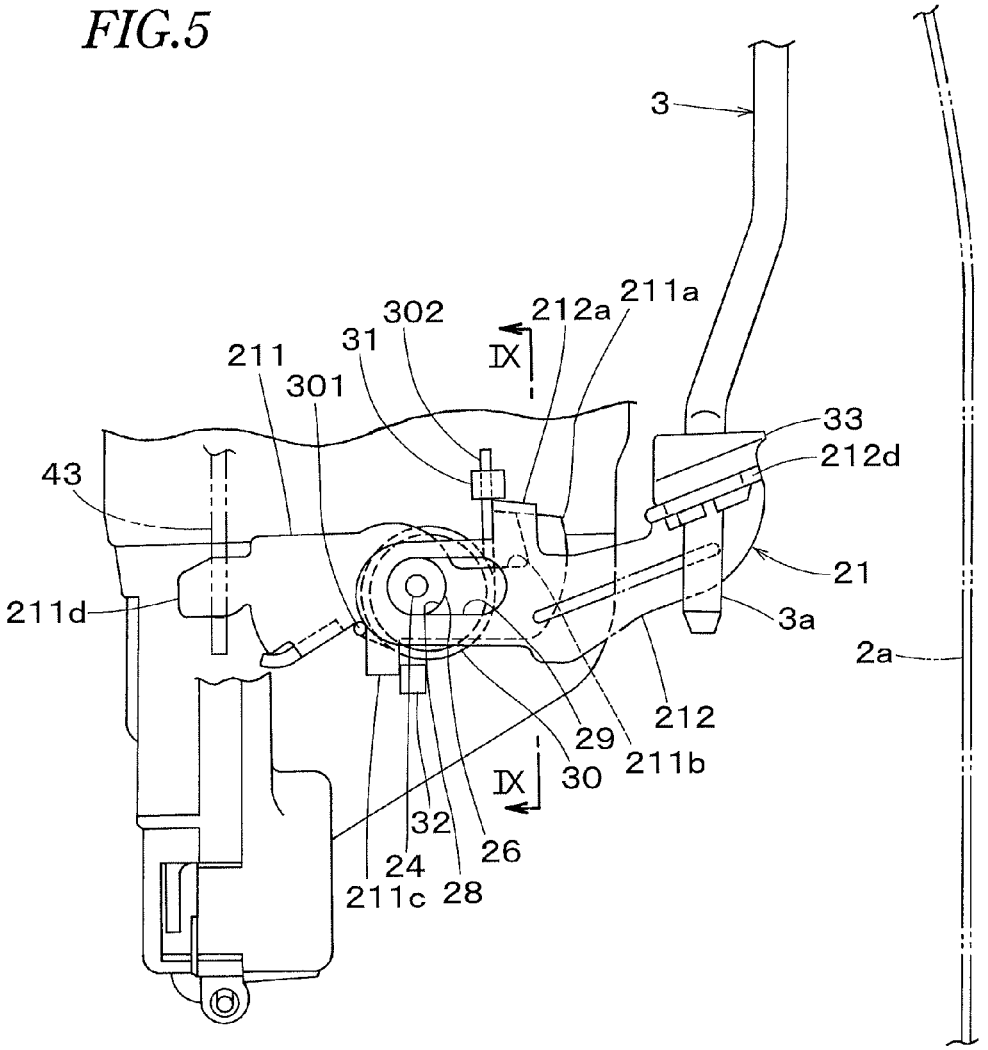
FIG. 5 is an enlarged view of an outside-lever mounting portion of the door latch device.

In FIGS. 3-5, the outside lever 21 comprises the first outside lever 211 extending transversely of the vehicle body and having an axial hole 28 in the middle; and a second outside lever 212 extending transversely of the vehicle body and having an elongate hole 29 at an inner part. A pivot shaft 26 of the first casing 201 pivotally engages in the axial hole 28 of the first outside lever 211. The second outside lever 212 overlaps a rear surface of the first outside lever 211 so that the elongate hole 29 can move inward of the vehicle and turn. The second outside lever 212 moves relatively with respect to the first outside lever 211 transversely of the vehicle. In this embodiment, the length of the elongate hole 29 is approximately twice as long as the diameter of the pivot shaft 26, but may be changed.

At the end of the first outside lever 211 facing the outer panel 2*a*, there is provided an engaged upward projection 211*a* in which the upper end face is tilted to correspond to an engaging projection 212*a* of the second outside lever 212, and a recess 211*b* is formed on the engaged projection 211*a*. At the lower end of the first outside lever 211 slightly inward of the axial hole 28, an engagement portion 211*c* for engaging one arm 1 of a torsion spring 30 projects downward.

In the middle of an upper part of the second outside lever 212, there is formed an L-shaped engagement projection 212*a* tilted tangentially at a turning path of the second outside lever 212. When the second outside lever 212 is placed at a usual position described as below, a lower surface of the engagement projection 212*a* comes in contact with an upper surface of the engaged projection 211*a* of the first outside lever 211 in FIG. 5. The engaged projection 211*a* and engagement projection 212*a* constitute connecting means for connecting the first outside lever 211 to the second outside lever 212.

Between the first casing 201 and the first outside lever 211, a torsion spring 30 freely fits about the pivot shaft 26. The arm 301 of the torsion spring 30 engages with the engagement portion 211*c* of the first outside lever 211, and the other arm 302 elastically engages in an engagement projection 31 on the rear surface of the first casing 201 from a left in FIG. 5.

Thus, the first outside lever 211 is biased counterclockwise about the pivot shaft 26 in FIGS. 2 and 3. The upper end of the engaged projection 211*a* comes in contact with the lower surface of the engagement projection 212*a* of the second outside lever 212, so that the second outside lever 212 is also biased counterclockwise about the pivot shaft 26. The whole outside lever 21 is biased counterclockwise by the torsion spring 30. The outward side edge of the engagement portion 211*c* of the first outside lever 211 comes in contact with the inward side edge of a stopper 32 of the first casing 201, so that the whole outside lever 21 is held at a usual position in FIGS. 2 and 5.

Figure 9:
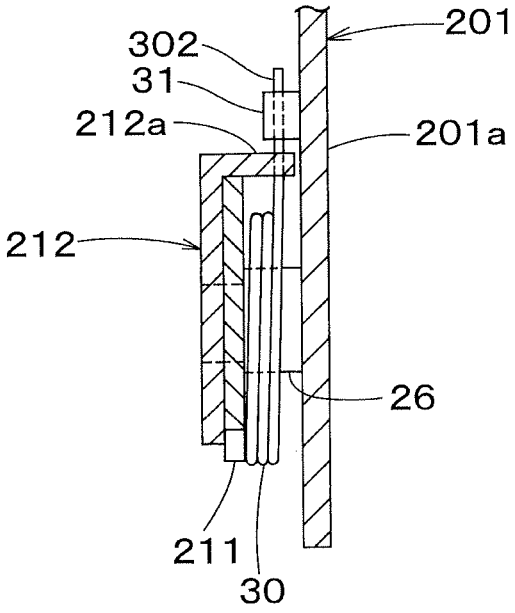
FIG. 9 is a vertical sectional view taken along the line IX-IX in FIG. 5.

In FIGS. 2, 5 and 9, the upward arm 302 of the torsion spring 30 biases the second outside lever 212 outward of the vehicle and also acts as biasing means toward a usual position, which means that the engagement projection 212*a* of the second outside lever 212 can come in contact with the engaged projection 211*a* of the first outside lever 211 in which releasing action of the second outside lever 212 can be transmitted to the first outside lever 211. The releasing action means that the second outside lever 212 turns at a certain angle clockwise against the force of the torsion spring 30 according to opening action of the outside handle 4. That is to say, when the whole outside lever 21 is in the usual position, the inward side edge of the engagement projection 212*a* of the second outside lever 212 comes in contact with the upward arm 302 of the torsion spring 30, so that the second outside lever 212 is biased outward by the torsion spring 30 anytime. The pivot shaft 26 comes in contact with the inward side edge of the elongate hole 29 to prevent the second outside lever 212 from moving outward, so that second outside lever 212 is held in the usual position.

The inner end 211*d* of the first outside lever 211 in the casing 20 is connected to the release lever 43 in the second casing 202. At the outward end of the second outside lever 212 facing the outer panel 2*a* and projecting from the first casing 201, there is integrally formed a connecting portion 212*d* having a vertical through hole (not shown). A synthetic-resin receipt member 33 is pressingly fitted in the through hole of the connecting portion 212*d*. To the connecting portion 212*d* is connected via the receipt member 33 a crank-shaped bent portion 3*a* at the lower end of the motion-transmitting member 3 comprising a rod which is connected to the outside handle 4 thereby enabling motion of the outside handle 4 to be transmitted to the second outside lever 212.

In FIGS. 5-8, it will be described with respect to function of the door latch device 1 in this embodiment, particularly motion of the outside lever 21 when the side is impacted.

Figure 6:
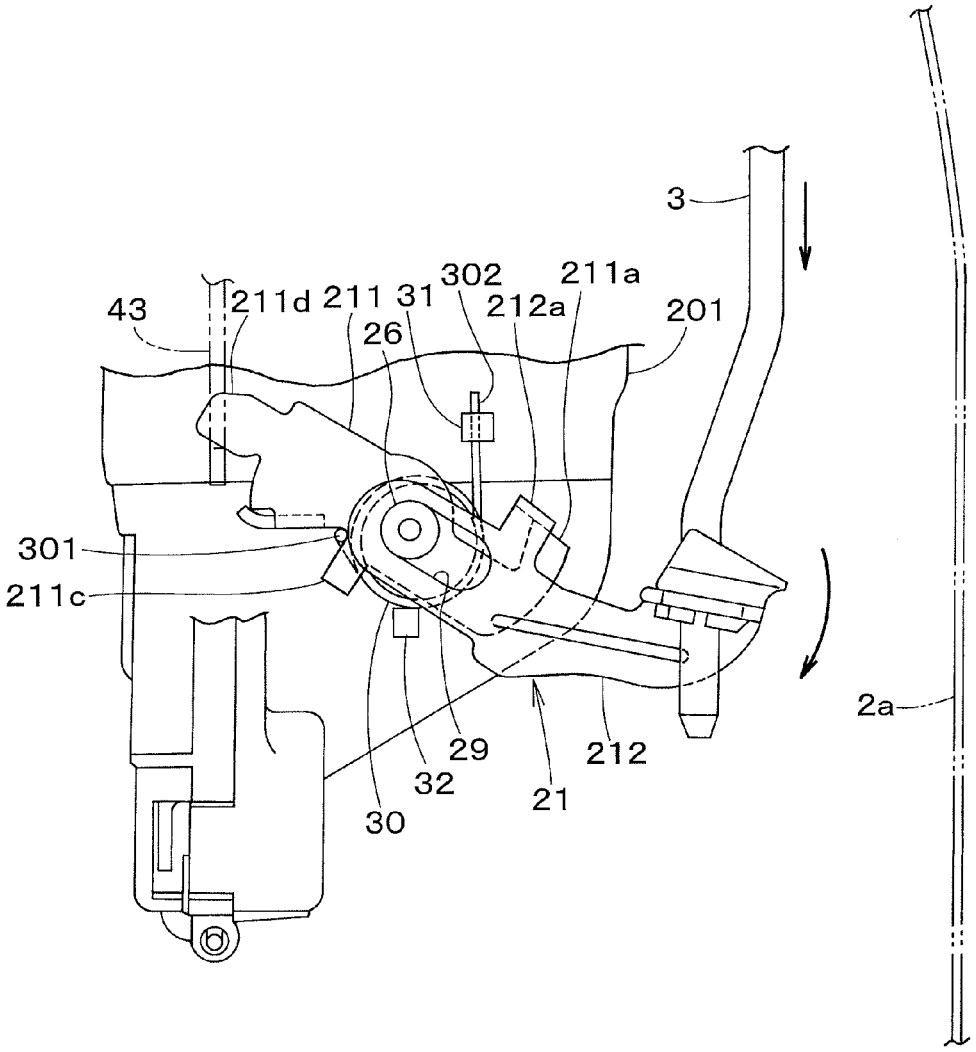
FIG. 6 is an enlarged view when the outside lever turns downward in a usual position.

FIGS. 5 and 6 illustrate a usual state of the door latch device 1 in which the door is closed. The outside handle 4 is operated to open the door, and the motion-transmitting member 3 connected thereto moves down, so that in FIG. 6, the whole outside lever 21 which comprises the second outside lever 212 and the first outside lever 211 of which the engaged projection 211*a* engages with the engagement projection 212*a* of the second outside lever 212 turns at a certain angle against the torsion spring 30 from the usual position (door-closed position) in FIG. 5 to the operating position (door-open position) in FIG. 6 in a releasing direction or clockwise in FIG. 5.

Accordingly, when the lock knob is in an unlocking state and when the locking lever and release lever are in an unlocking position, the release lever 43 connected to the inner end 211*d* of the first outside lever 211 moves up and comes in contact with the ratchet pin 171 from below, so that the ratchet 17 disengages from the latch 15 to enable the door 2 to open. In the usual state in FIGS. 5 and 6, as mentioned above, the second outside lever 212 is pressed outward of the vehicle anytime by a force of the upward arm 302 of the torsion spring 30, so that the engaged projection 211*a* is unlikely to disengage from the engagement projection 212*a*, and the first outside lever 211 and second outside lever 212 are actuated as the single outside lever 21 thereby providing high reliability as the door latch device 1.

Figure 7:
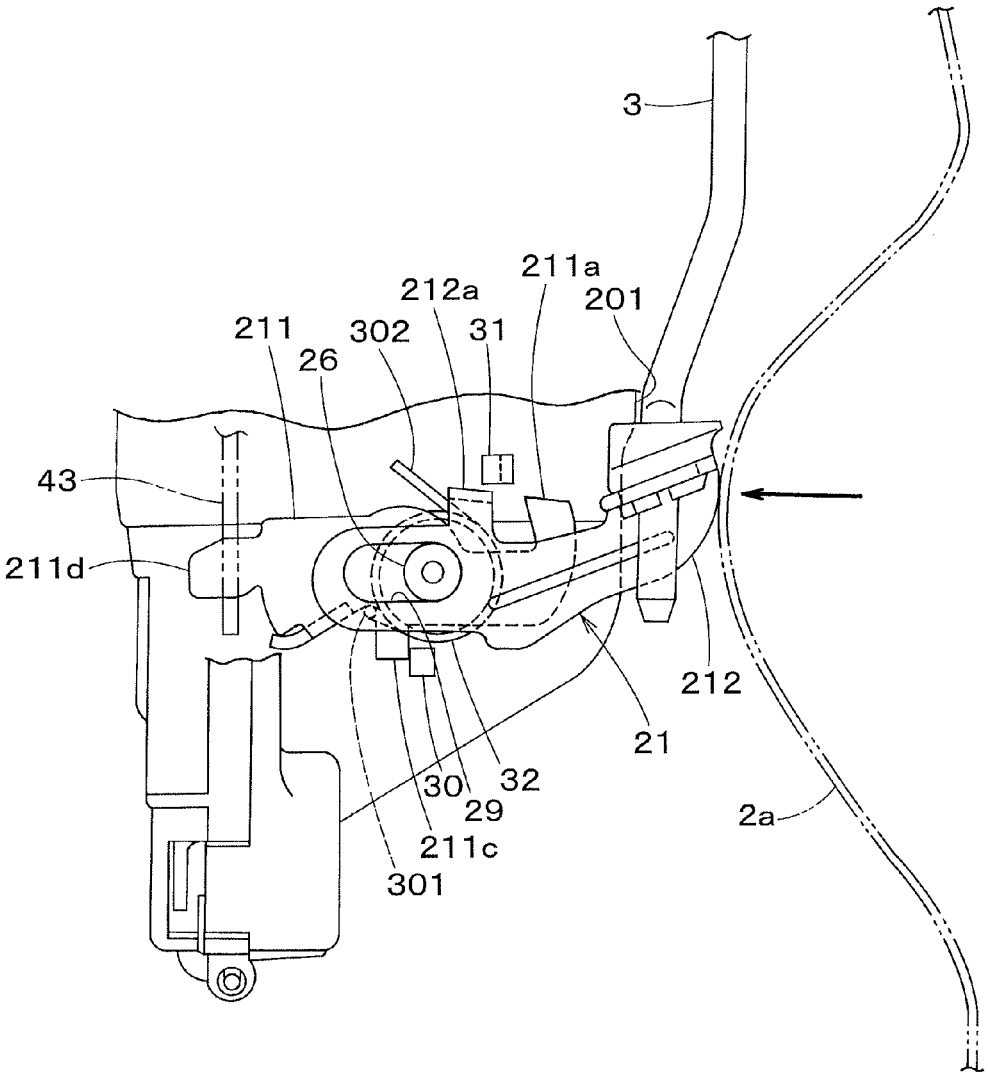
FIG. 7 is an enlarged view showing motion of a second outside lever right after impact.

In FIG. 7, when the door 2 is closed, the outer panel 2*a* of the door 2 is deformed at the beginning by impact, and impact exerts the outside lever 21 of the door latch device 1. Only the second outside lever 212 pivotally mounted in the elongate hole 29 on the pivot shaft 26 moves relatively with respect to the pivot shaft 26 and first outside lever 211 inward of the vehicle against a force of the torsion spring 30, and is held at a position where the pivot shaft 26 is in contact with the side edge of the elongate hole 29. Then, the engagement projection 212*a* of the second outside lever 212 moves inward away from the engaged projection 211*a* of the first outside lever 211, so that the engagement projection 212*a* disengages from the engaged projection 211*a*. When impact exerts onto the motion-transmitting member 3 through deformation of the outer panel 2*a* to make the motion-transmitting member 3 pushed toward the inside of the vehicle, the second outside lever 21 moves toward the inside of the vehicle to disengage from the first outside lever 211.

The second outside lever 212 moves inward of the vehicle, and the arm 302 of the torsion spring 30 which is in contact with the engagement projection 212*a* moves inward, so that the second outside lever 212 moves inward without hindrance. While the deformed outer panel 2*a* is restored toward the outside of the vehicle and leaves the second outside lever 212, the second outside lever 212 is moved toward the outside of the vehicle by force of the arm 302 of the torsion spring 30 thereby engaging the engaged projection 211*a* of the first outside lever 211 with the engagement projection 212 of the second outside lever 212.

Figure 8:
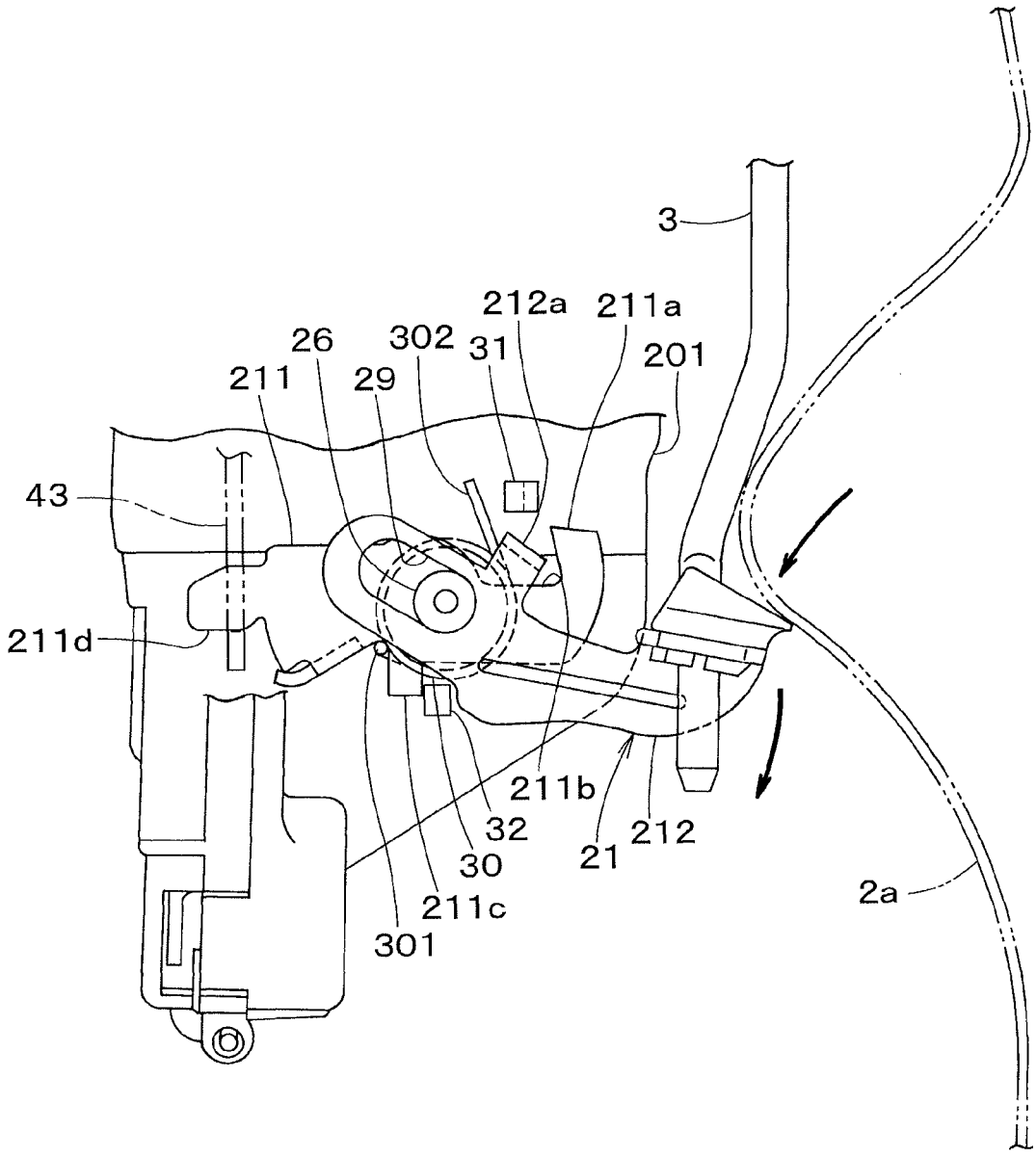
FIG. 8 is an enlarged view when the second outside lever turns downward by impact.

The outer panel 2*a* in FIG. 7 is further deformed in FIG. 8 to turn the second outside lever 212 downward, and the second outside lever 212 turns in a releasing direction or clockwise in FIG. 7 against the force of the torsion spring 30. But the engagement projection 212*a* of the second outside lever 212 disengages from the engaged projection 211*a* of the first outside lever 211, so that rotation of the second outside lever 212 in a releasing direction is not transmitted to the first outside lever 211. Thus, only the second outside lever 212 turns in a releasing direction, but the first outside lever 211 does not turn in the releasing direction. When only the second outside lever 212 turns in the releasing direction, the engagement projection 212*a* comes into the recess 211*b* of the first outside lever 211, and the engagement projection 212*a* does not engage with the engaged projection 211*a* again.

Even if the outer panel 2*a* is deformed by impact, the second outside lever 212 is relatively moved inward of the vehicle with respect to the first outside lever 211 and the first outside lever 211 is disengaged from the second outside lever 212. Only the second outside lever 212 can be turned in the releasing direction, and the pivoting of the second outside lever 212 is not transmitted to the first outside lever 211. Hence, the ratchet 17 still engages with the latch 15 thereby preventing the door 2 from opening accidentally.

Figure 10:
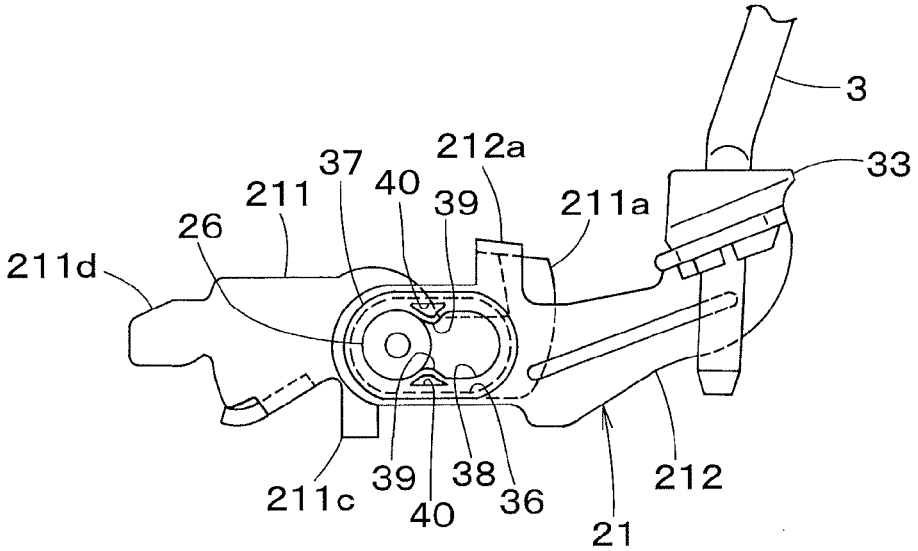
FIG. 10 is an enlarged view showing a variation of biasing means of the second outside lever.
Figure 11:
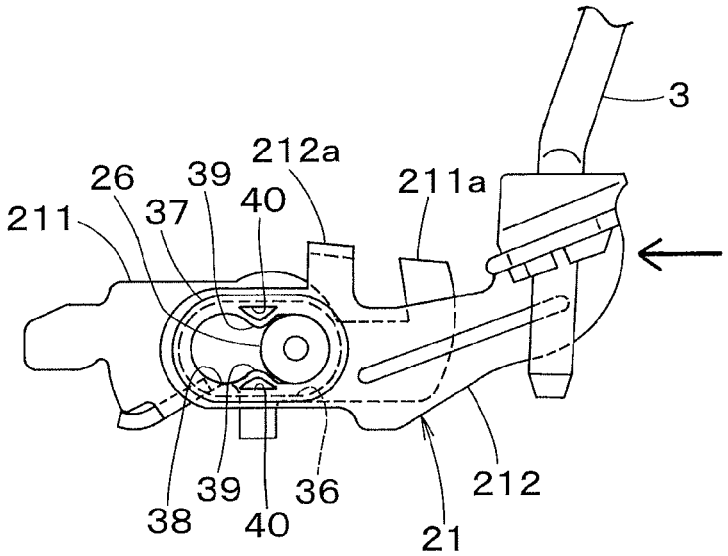
FIG. 11 is an enlarged view showing motion of the second outside lever by impact.

FIGS. 10 and 11 is a variation of biasing means for a second outside lever 212 in the foregoing embodiment of the door latch device. The same numerals are allotted to the same elements as those in the foregoing embodiment and its detailed description is omitted. The casing 20 and torsion spring 30 are omitted.

In this variation, the second outside lever 212 has an engagement hole 36 larger than the elongate hole in the foregoing embodiment. A synthetic-resin guide member 37 which is pressingly fitted in the engagement hole 36 has an elongate hole 38 in which a pivot shaft 26 can slide and pivot. Elastically-holding portions 39,39 are formed to project to face each other into the elongate hole 38. Openings 40,40 are formed in the elastically-holding portions 39 so that the elastically-holding portions 39 leave each other vertically by elastic deformation.

When the outside lever 21 is in a usual position in FIG. 10, the pivot shaft 26 is elastically held by the two elastically-holding portions 39 on the end of the elongate hole 38 toward the inside of the vehicle, and the second outside lever 212 projects toward the outside of the vehicle maximally. Similar to FIG. 6, the door latch device is usually actuated by door-opening operation of an outside handle 4.

In FIG. 11, the second outside lever 212 is pushed by and external force caused by impact, and the pivot shaft 26 relatively moves to the end near the outside of the vehicle while the pivot shaft 26 makes the elastically-holding portions 38 go away from each other with elastic deformation. Thus, similar to FIG. 7, the engagement projection 212*a* of the second outside lever 212 disengages from an engaged projection 211*a* of a first outside lever 211. Even if the second outside lever 212 is subjected to downward impact, its rotation is not transmitted to the first outside lever 211 and the door 2 is still closed.

In this variation, the second outside lever 212 is held anytime to project toward the outside of the vehicle by the two elastically-holding pieces 39. It is not necessary to bias the second outside lever 212 anytime toward the outside of the vehicle by the arm 302 of the torsion spring 30 as mentioned above, but the torsion spring may be employed together. In this variation, the elastically-holding pieces 39 may be inclined only toward the inside of the vehicle.

Figure 12:
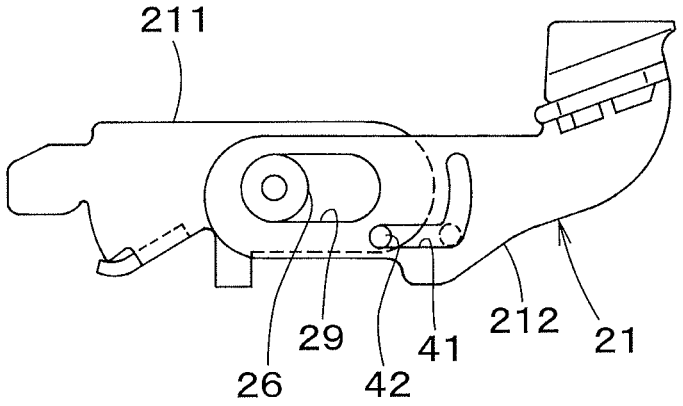
FIG. 12 is an enlarged view of a variation of connecting means between a first outside lever and the second outside lever.
Figure 13:
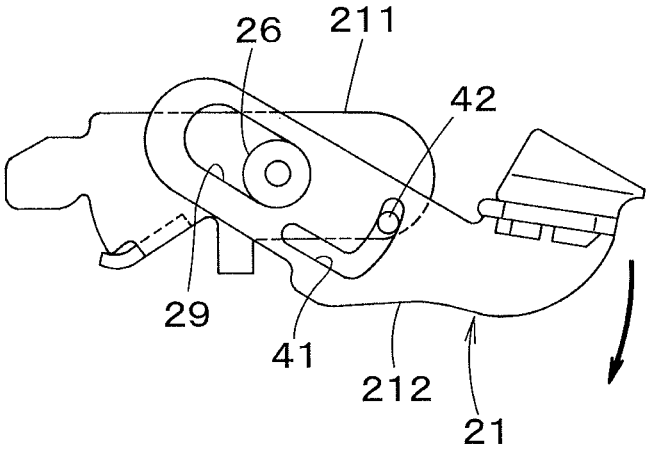
FIG. 13 is an enlarged view showing motion of the second outside lever by impact.

FIGS. 12 and 13 illustrate a variation of connecting means between a first outside lever 211 and a second outside lever 212 of the door latch device in the foregoing embodiment in which the first outside lever 211 is connected to the second outside lever 212 to move together and is disconnected by impact. The casing 20 and torsion spring 30 are omitted.

In this variation, at a position nearer than an elongate hole 29 of the second outside lever 212 toward the outside of the vehicle, there is formed an L-shaped engagement hole 41 in which an engagement pin 42 slides. The engagement pin 42 projects at a position nearer than a shank hole 28 of the first outside lever 211 toward the outside of the vehicle and is positioned at the side end of the engagement hole 44 toward the inside of the vehicle when the outside lever 21 is in a usual position in FIG. 12.

When a door is normally opened, the engagement pin 42 engages in the engagement hole 41, and the first outside lever 211 turns clockwise together with the second outside lever 212. In FIG. 13, by impact, the engagement pin 42 moves along the engagement hole 41, and only the second outside lever 212 turns downward. Pivoting is not transmitted to the first outside lever 211. In this variation, oppositely to the foregoing, an engagement hole and an engagement pin may be formed on the first and second outside levers respectively.

Figure 14:
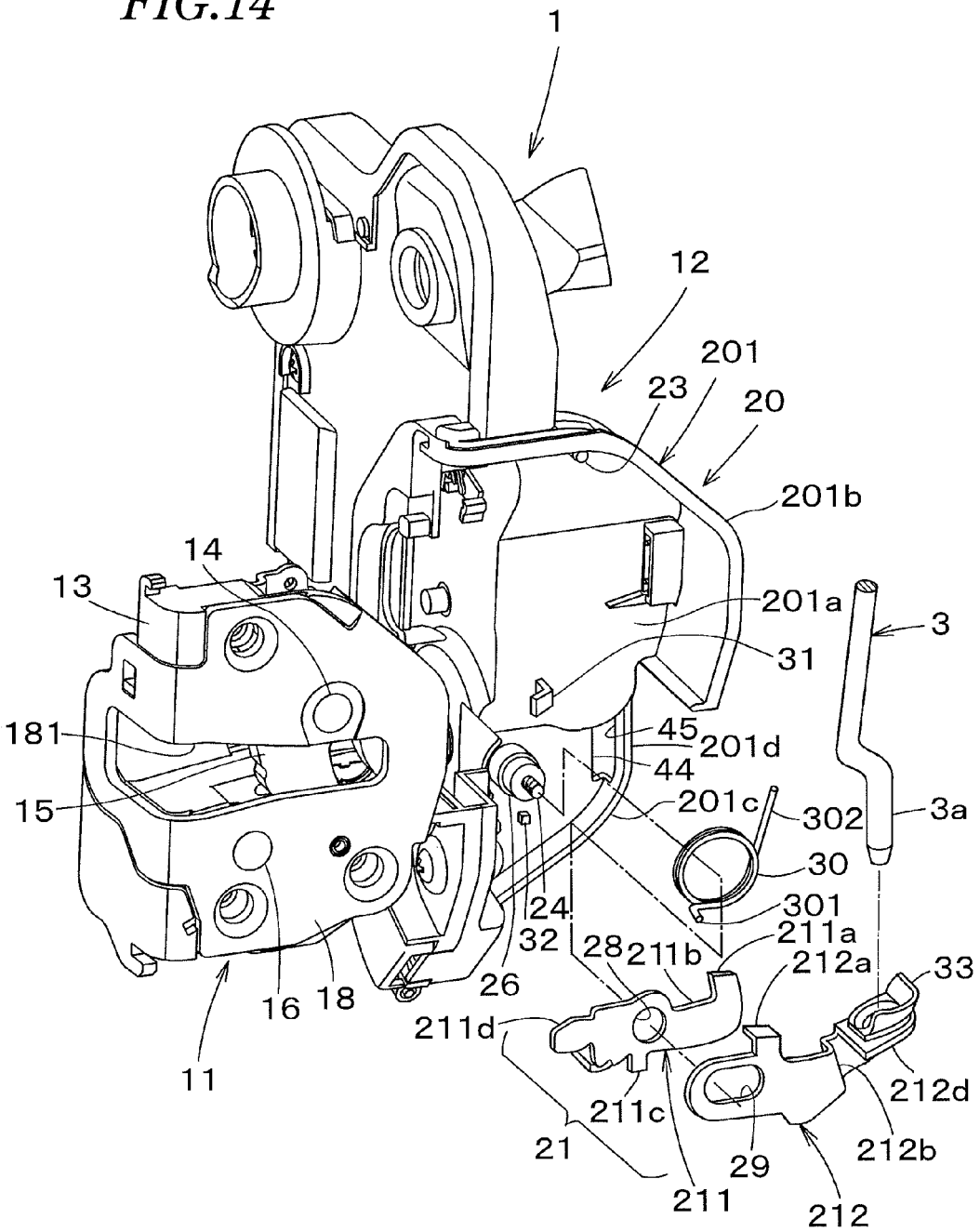
FIG. 14 is an exploded perspective view of a second embodiment of a door latch device according to the present invention.
Figure 15:
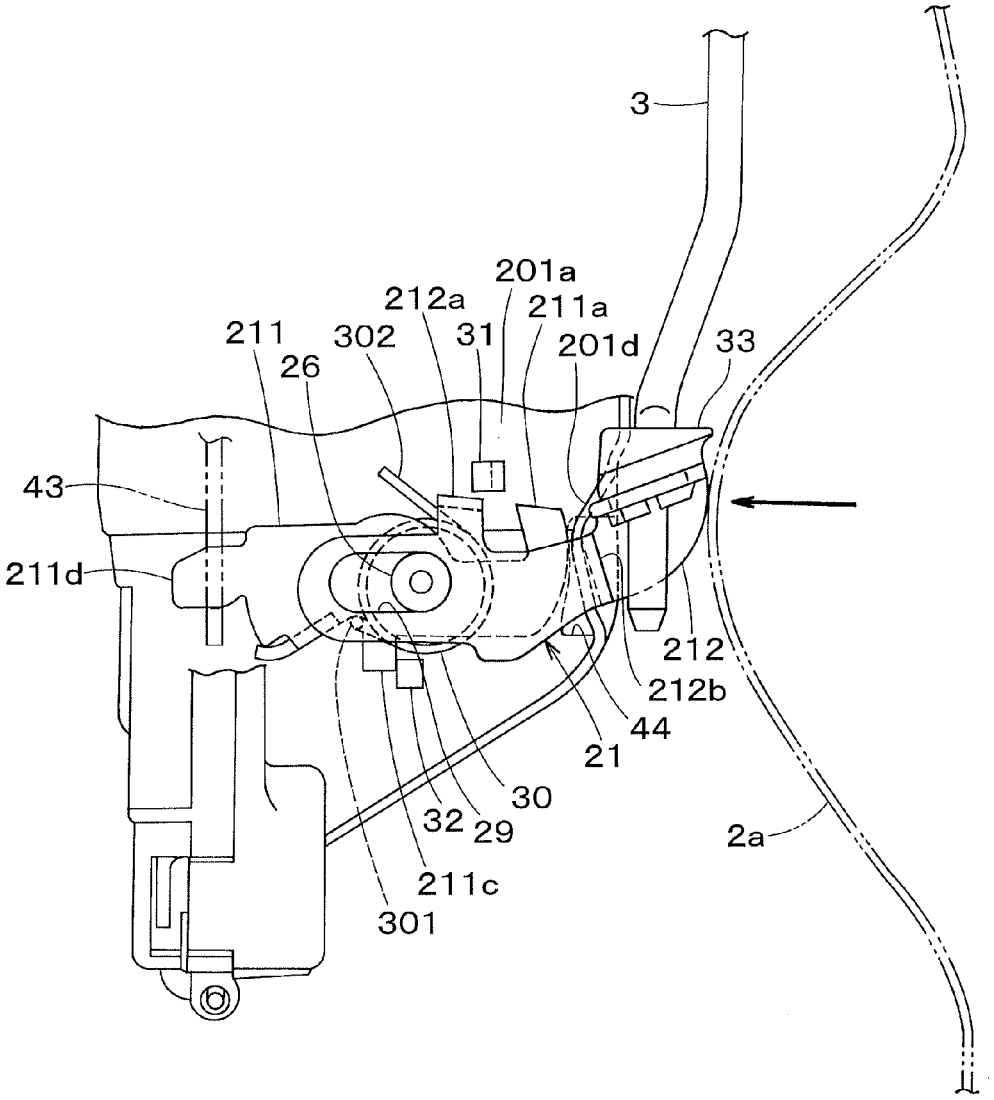
FIG. 15 is an enlarged view of an outside lever mounting portion of the same.

FIGS. 14 and 15 illustrate a second embodiment of a door latch device according to the present invention. The same numerals are allotted to the same elements as those in the first embodiment, and detailed description thereof is omitted.

In this embodiment, over the outer circumference of a lower half of a base 201*a* of a first casing 201, a lower side wall 201*c* smaller in projecting size than an upper side wall 201*b* projects backward. In an outer edge portion of the base

201*a* facing the pivot shaft 26, there is formed a vertically-extending rectangular opening 44 which runs through the base 201*a*, and there is a notch 45 continuous with the rectangular opening 44 in the lower side wall 201*c* facing the pivot shaft 26. There is formed a weaker portion 201*d* shorter than the other portions in a longitudinal direction of the vehicle, at a position of the lower side wall 201*c* facing the pivot shaft 26.

The end of the second outside lever 212 which projects from the lower side wall 201*c* is bent like "L" toward the lower side wall 201*c*, and the inner side surface of a bent portion 212*b* is close to the outer side surface of the weaker portion 201*d* of the lower side wall 201*c*.

In the second embodiment of the door latch device, in FIG. 15, the second outside lever 212 moves toward the inside of the vehicle through deformation of the outer panel 2*a*, the bent portion 212*b* comes in contact with the lower side wall 201*c* of the first casing 201. Because the weaker portion 201*d* is provided at the lower side wall 201*c* to face the pivot shaft 26, the bent portion 212*b* moves inward while the bent portion 212*b* deforms the weaker portion 201*d* inward if strong impact acts to the second outside lever 212. Because the weaker portion 201*d* is deformed toward the inside of the vehicle by impact, the bent portion 212*b* of the second outside lever 212 comes into the recess 44 of the first casing 201, thereby preventing the second outside lever 212 from turning in a releasing direction.

When impact which exerts the second outside lever 212 is relatively small so that the weaker portion 201*d* is not deformed, the second outside lever 212 does not move toward the inside of the vehicle, so that the door latch device 1 is held in door-closing state and the door can also be opened.

In the first and second embodiments, the deformed outer panel 2*a* itself comes in contact with and moves the second outside lever 212 toward the inside of the vehicle thereby disconnecting the second outside lever 212 from the first outside lever 211.

Figure 16:
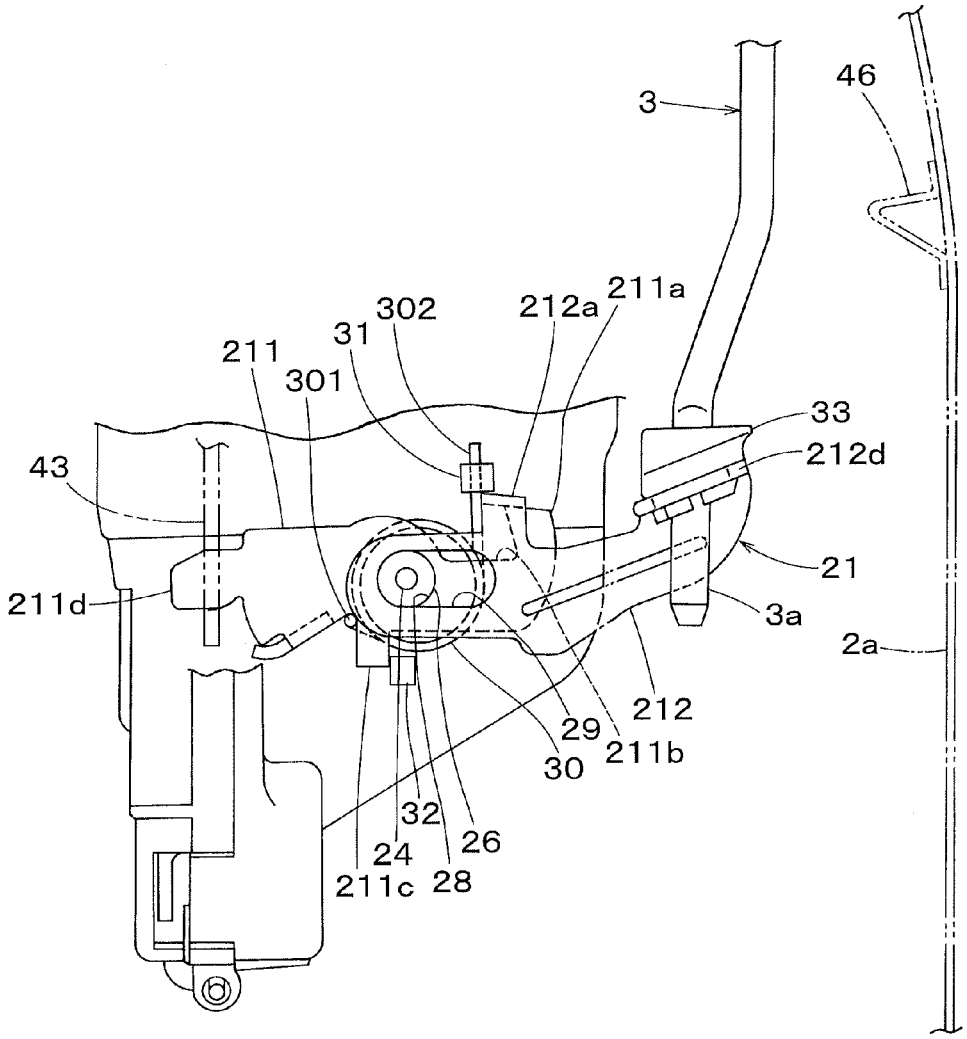
FIG. 16 is an enlarged view of the outside-lever mounting portion showing that a lever-pushing member is mounted to the outer panel.

For example, in FIG. 16, a lever-pushing member 46 is fixed on the inner surface of the outer panel 2*a* facing the lower part of the motion-transmitting member 3. The lever-pushing member 46 may move the second outside lever 212 toward the inside of the vehicle.

Figure 17:
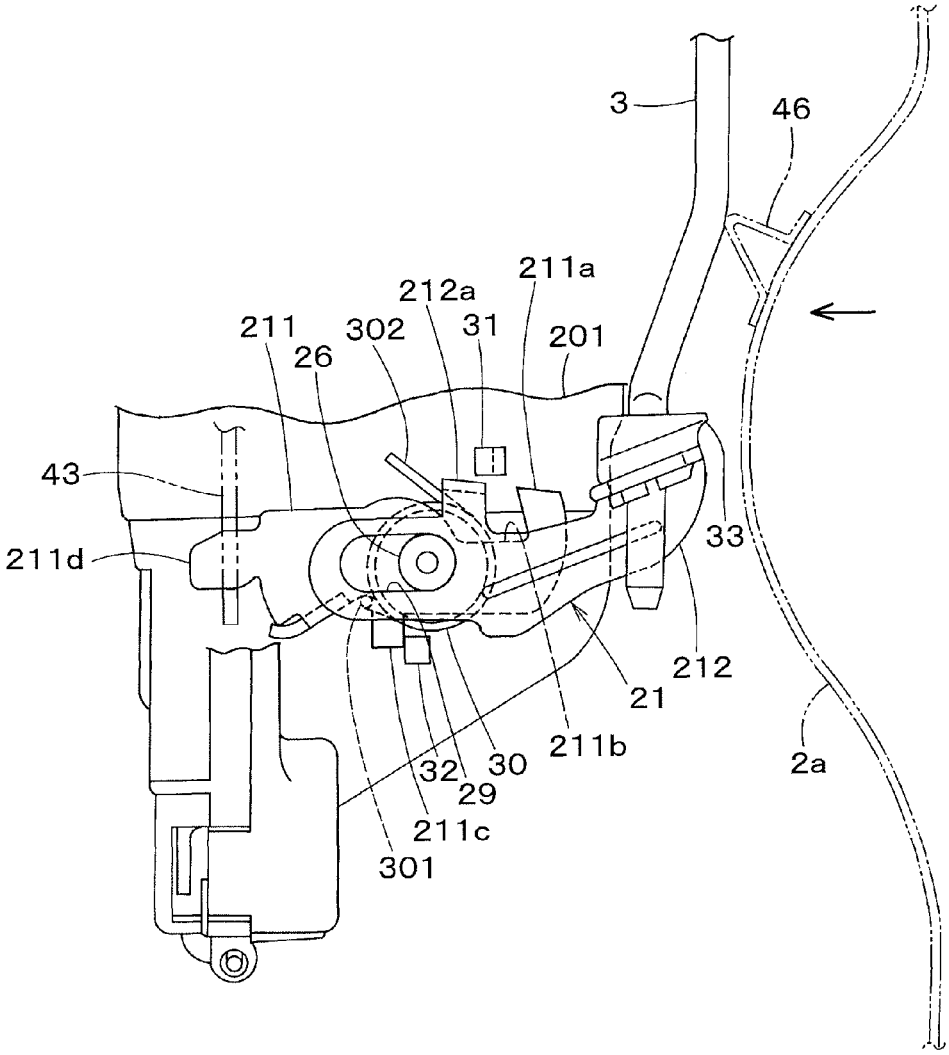
FIG. 17 is an enlarged view showing motion of the second outside lever by impact.

In FIG. 17, when the outer panel 2*a* is deformed toward the inside of the vehicle by impact, the tip of the lever-pushing member 46 comes in contact with the motion-transmitting member 3 prior to the outer panel 2*a*. Thus, the motion-transmitting member 3 and second outside lever 212 joined thereto is moved toward the inside of the vehicle. So the engagement projection 212*a* of the second outside lever 212 disengages from the engaged projection 211*a* of the first outside lever 211. Thereafter, even if downward impact exerts to the second outside lever 212, the first outside lever 211 does not turn in a releasing direction, so that the door 2 is still closed.

Omitting its illustration, the lever-pushing member 46 is provided to face the lower edge of outside-projecting end of the second outside lever 212. When the outer panel 2*a* is deformed toward the inside of the vehicle, the tip of the lever-pushing member 46 comes in contact with the lower edge of the projecting end of the second outside lever 212 or the lower end of the motion-transmitting member 3 to move the second outside lever 212 toward the inside of the vehicle while it turn counterclockwise.

In the first and second embodiments of the present invention, the arm 302 of the torsion spring 30 is used as biasing means for biasing the second outside lever 212 anytime, but another biasing means such as a tension coil spring may be used.

The door latch device in the embodiments comprises a rod as motion-transmitting member for pressing down the outer end of the outside lever 21, but the present invention may be applied to a door latch device in which the outside lever 21 is pulled up by a motion-transmitting member such as push-pull type or Bowden cable.

The door may be a rear door, a sliding door or a tailgate.

In FIGS. 18-21, a third embodiment of a door latch device according to the present invention will be described. The same numerals are allotted to the same elements as those in the first and second embodiments, and detailed description will be omitted.

Figure 18:
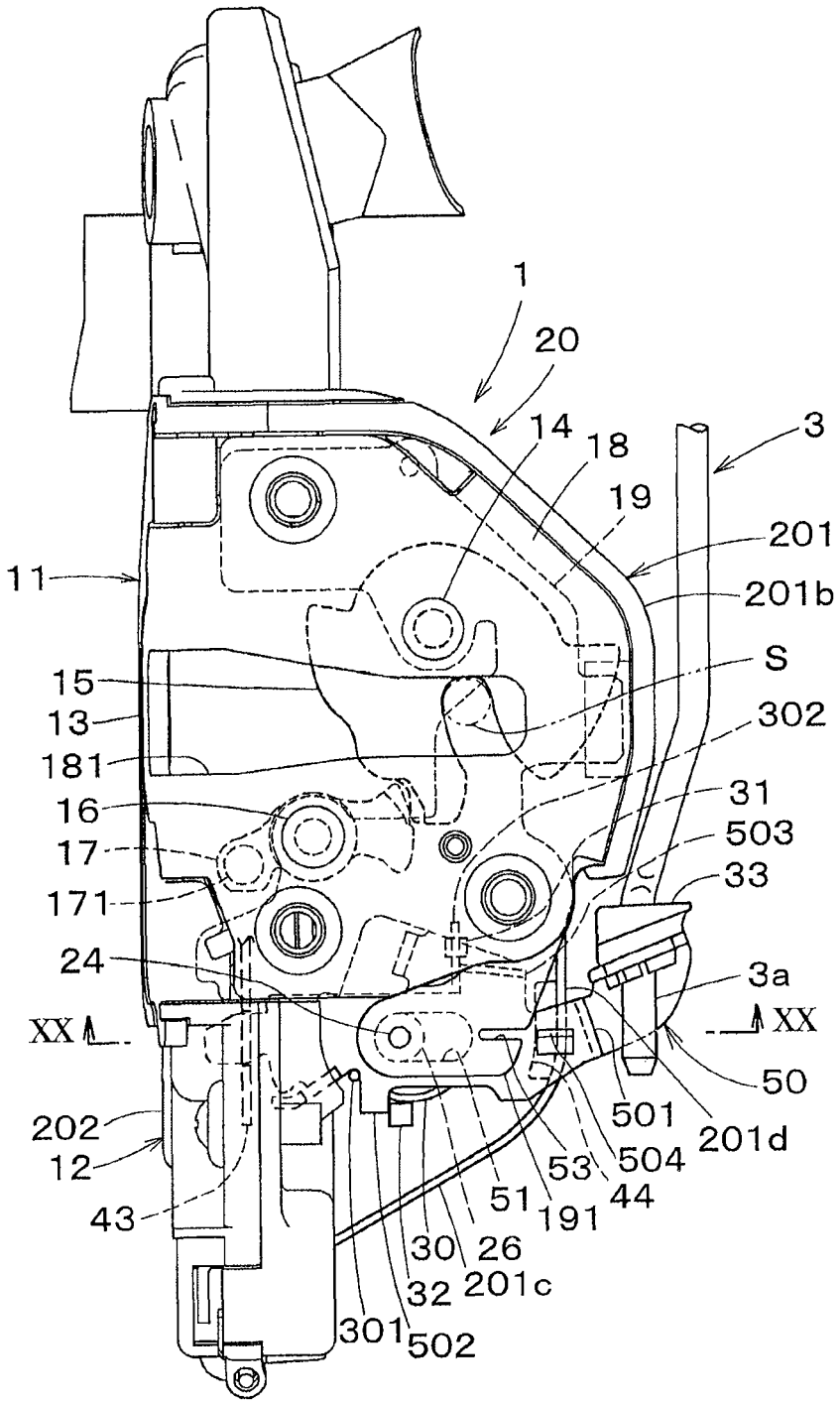
FIG. 18 of a third embodiment of a door latch device according to the present invention viewed from back of the vehicle.
Figure 19:
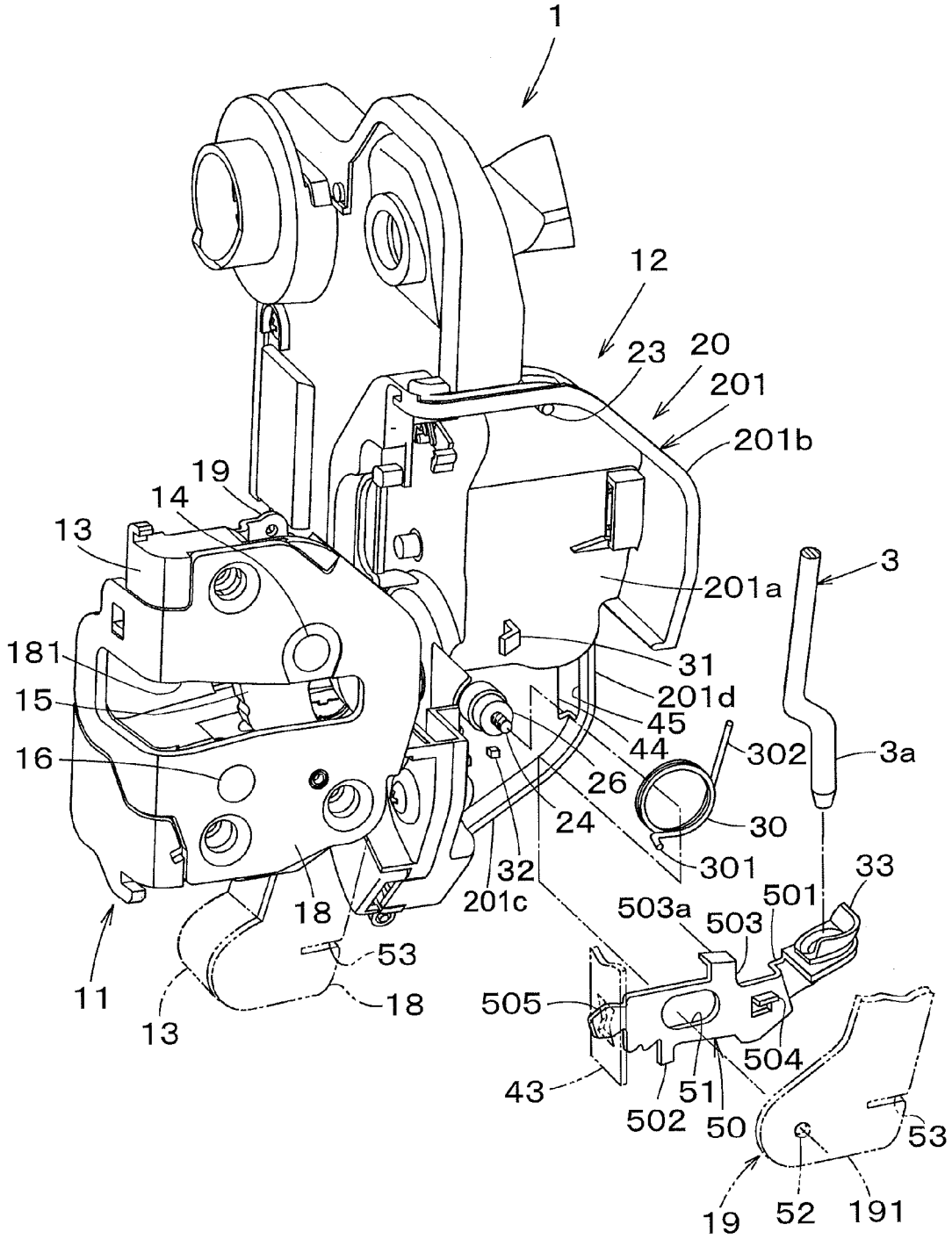
FIG. 19 is an exploded perspective view of the same.

In FIGS. 18 and 19, there is formed an elongate hole 51 in the middle of an outside lever 50. The elongate hole 51 freely fits about a pivot shaft 26 to turn and move horizontally. The elongate hole 51 of the outside lever 50 engages with the pivot shaft 26. Thereafter, the lower end of a back member 19 is fixed to the rear surface of the pivot shaft 26 by engaging a bolt 24 into an internal thread 52. In this embodiment, the elongate hole 51 is about twice as long as the diameter of the pivot shaft 26, but may suitably be determined. The projecting end of the outside lever 50 from a lower side wall 201*c* is bent like "L", and the inner side surface of the bent portion 501 is close to the outer side surface of a weaker portion 201*d* of the lower side wall 201*c*. To a receipt member 33 at the outer end of the outside lever 50 is coupled the lower end of the motion-transmitting member 3.

On the lower edge close to an inner end of the elongate hole 51 of the outside lever 30, there is formed an engagement portion 502 which engages with one arm 301 of a torsion spring 30. On the upper edge close to an outer end of the elongate hole 51 of the outside lever 50, there is formed an L-shaped upper engagement portion 503 with which the other arm 302 of the torsion spring 30 is in contact. On the back surface of the outside lever 50, part of the outside lever 50 is cut and raised to form a projection 504 on a line extending from the middle of a vertical length of the elongate hole 51. The front face of the outside lever 50 is pressed by a press and raised backward, or another member is welded to form the projection 504.

The arm 302 which extends upward in the torsion spring 30 engages with an engagement projection 31 on the back surface of a base 201*a* from the left side in FIG. 19, and the other arm 301 elastically engages with the engagement portion 502 of the outside lever 50 from the left side in FIG. 19. Accordingly, the outside lever 50 is biased counterclockwise about the pivot shaft 26 in FIGS. 18 and 19. The arm 302 of the torsion spring 30 acts as biasing means for holding the outside lever 50 in a usual position by biasing the outside lever 50 toward the outside of the vehicle. The outside lever 50 is biased toward the outside of the vehicle anytime by force of the torsion spring 30 by contacting the arm 302 of the torsion spring 30 to the inward side edge of a forward portion 503*a* of the upper engagement portion 503 of the outside lever 50. By contacting the pivot shaft 26 to the inward edge of the elongate hole 51, the outside lever 50 projects maximally toward the outside of the vehicle and is held in the usual position.

Figure 20:
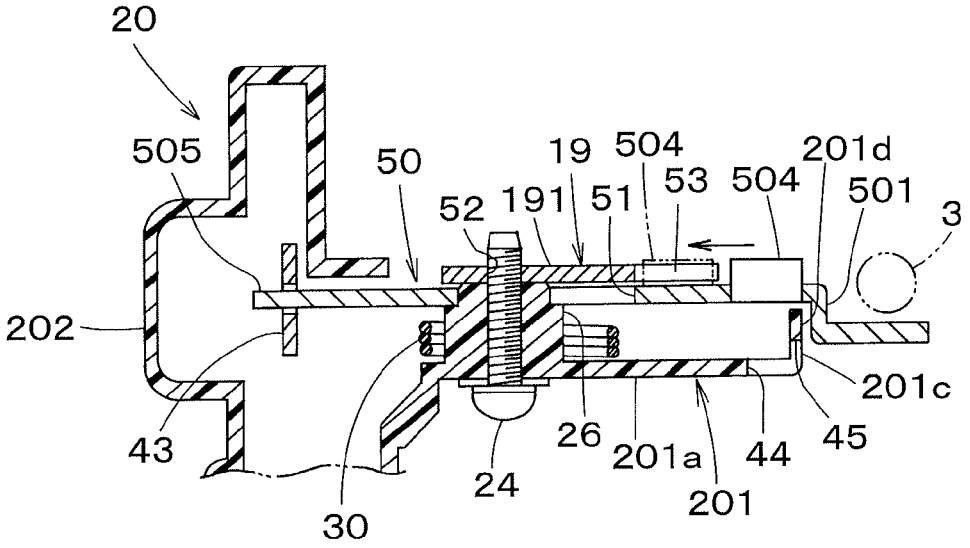
FIG. 20 is a horizontal sectional view taken along the line XX-XX in FIG. 18.

On the back surface of the base 201*a* of the first casing 201 under the pivot shaft 26, there is formed a stopper 32 for holding the outside lever 50 in the usual position in FIGS. 18 and 20 by contacting an outward side of the lower engagement portion 502 of the outside lever 50 to the stopper 32. When the outside lever 50 is in the usual position, the projection 504 is slightly spaced away from the outer side of a lower end 191 of the back member 19.

In FIGS. 18 and 20, there is formed an engagement portion 53, such as a slit, which faces the projection 504 of the outside lever 50 at the outward side edge of a lower end 191 of the back plate 19. A vertical width of the engagement portion 53 is slightly larger than thickness of the projection 504. When the outside lever 50 moves relatively with respect to the pivot shaft 26, the projection 504 enters and engages in the engagement portion 53. The engagement portion 53 may be a groove instead of a slit. The engagement portion 53 of the back member 18 corresponds to a stopper in this invention.

The function of the third embodiment of the door latch device, particularly motion of the outside lever 50 by impact will be described.

FIG. 18 illustrates a usual state or a door-closing state of the door latch device 1. The outside handle 4 is operated to open the door and the motion-transmitting member 3 connected thereto moves down. The outside lever 50 turns at a certain angle in a releasing direction or clockwise in FIG. 18 against the torsion spring 30 from the usual position or door-closing position to an actuating position or door-open position.

When the lock knob 10 is in an unlocking state and when the release lever 43 connected to the locking lever and the inner end of the outside lever 50 is in an unlocking position, the release lever 43 moves up to come in contact with the ratchet pin 171. Hence, the ratchet 17 disengages from the latch 15 to enable the door 2 to open. As mentioned above, in the usual state in FIG. 18, the outside lever 50 is biased by the arm 302 of the torsion spring 30 toward the outside of the vehicle and is unlikely to move inward of the vehicle.

Figure 21:
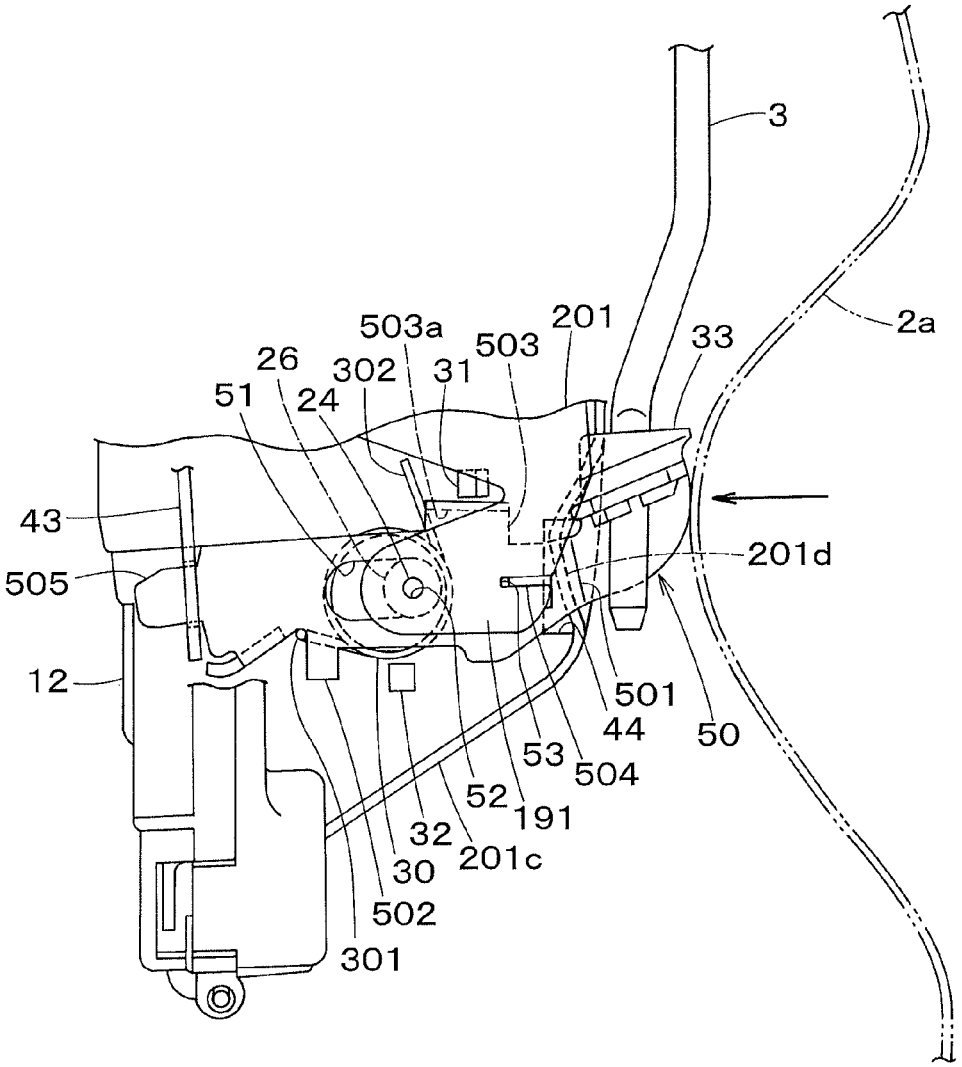
FIG. 21 is an enlarged view showing motion fo the outside lever by impact.

When the door 2 is open in FIG. 21, the outer panel 2*a* of the door 2 is deformed toward the inside of the vehicle by impact, and impact exerts the outside lever 50 of the door latch device 1. The outside lever 50 moves relatively with respect to the pivot shaft 26 against the force of the torsion spring 30 and stops at a position where the pivot shaft 26 comes in contact with the outer edge of the elongate hole 51.

With the movement, the projection 504 of the outside lever 50 enters and engages in the engagement portion 53 of the lower part 191 of the back plate 19. Thus, even if the outer panel 2*a* is further deformed to turn the outside lever 50 downward, the outside lever 50 is not rotated in a releasing direction or clockwise in FIG. 21, so that the door 2 is prevented from opening accidentally In the third embodiment, there is a weaker portion 201 facing the pivot shaft 26 at the lower side wall 201*c*. Even if high impact exerts the outside lever 50, the weaker portion 201*d* is deformed inward with the bent portion 501, and the outside lever 50 can move inward of the vehicle. If impact which exerts the outside lever 50 is too low to deform the weaker portion 201*d*, the outside lever 50 does not move inward of the vehicle, and the door latch device 1 is held in a usual door-closing state. By impact, the weaker portion 201*d* is deformed inward of the vehicle, the bent portion 501 of the outside lever 50 enters a rectangular hole 44 of the first casing 201, so that the outside lever 50 is prevented from turning in the releasing direction.

If the deformed outer panel 2*a* is restored outward of the vehicle to leave the outside lever 50, the outside lever 50 moves outward of the vehicle by the torsion spring 30 to make the projection 504 disengage from the engagement portion 504, and the door latch device 1 returns to the usual state where the door 2 is closed.

Omitting illustration, the engagement portion 53 is formed on the side edge of the base 201*a* of the first casing 201 which is a turning path of the outside lever. The projection 504 is formed in the front face of the outside lever 50. If the outside lever 50 moves inward of the vehicle, the projection 504 comes into the engagement portion 53 to prevent the outside lever 50 from turning in the releasing direction. In this case, the base 201*a* may have neither lower side wall 201*c* nor rectangular hole 44.

Figure 22:
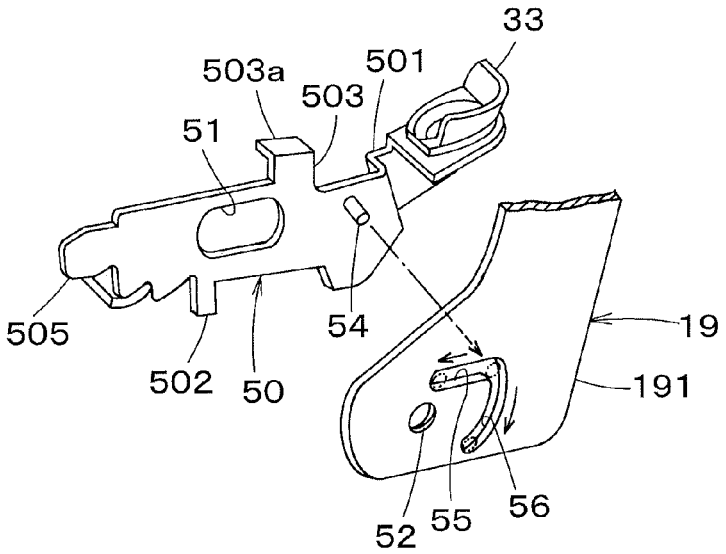
FIG. 22 is a perspective view of an outside lever and a back member in a fourth embodiment of a door latch device according to the present invention.

FIG. 22 is a perspective view of a fourth embodiment of a door latch device according to the present invention. The same numerals are allotted to the same elements as those in the third embodiment, and description is omitted.

In the fourth embodiment of the door latch device, there is provided an engagement pin 54 spaced from the elongate hole 51 toward the outside of the vehicle and directed in the same direction as the pivot shaft of the outside lever 50. In the back plate 10 across the engagement pin 54, there are formed an engagement hole 55 extending transversely of the vehicle. The engagement pin 54 slides in and along the engagement hole 55. A guide hole 56 which is an arc around the pivot shaft 26 as a center communicates with the engagement hole 55. The engagement hole 55 in which the engagement pin 54 slides acts as a stopper in this invention.

When the outside lever 50 is in the usual position, the engagement pin 54 is located in a corner between the engagement hole 55 and the guide hole 56. When the outside lever 50 turns in the releasing direction, the engagement pin 54 moves along the guide hole 56, so that the door latch device 1 can be opened in a usual state.

If impact exerts onto the outside lever 50, the engagement pin 54 moves along the engagement hole 55 inward of the vehicle and is limited in vertical motion, so that the outside lever 50 is prevented from turning about the pivot shaft 26. Thus, the door 2 is prevented from opening accidentally similar to the third embodiment.

In a usual opening of the door, the engagement pin 54 moves along the guide hole 56, so that the outside lever 50 is unlikely to move inward of the vehicle against a force of the torsion spring 30.

Omitting illustration, in the fourth embodiment, opposite the above, the engagement pin 54 may be provided on the back plate 19, and the engagement hole 55 and arcuate guide hole 56 communicating with it may be formed in the outside lever 50 which becomes larger vertically. The engagement hole 55 and guide hole 56 as shown in FIG. 22 may be formed in the base 201*a* of the first casing 201, or may be formed in both the back member 10 and base 201*a*. When the engagement hole 55 and guide hole 56 are formed in the base 201*a*, the engagement pin 54 may project forward. When the engagement hole 55 and guide hole 56 are formed in both the back plate 19 and the base 201*a*, the engagement pin 54 may pass through the outside lever 50.

Furthermore, when the back member 19 is omitted, the body 13 or cover member 18 may partially extend downward, and the engagement hole 55 and guide hole 56 may be formed in one of the members.

Figure 23:
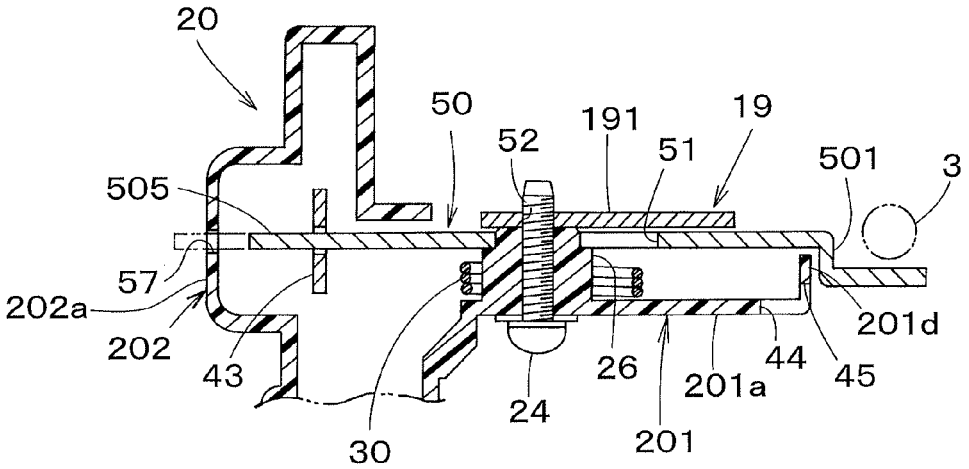
FIG. 23 is a horizontal sectional view of a fifth embodiment of a door latch device according to the present invention, at the same position as FIG. 20.

FIG. 23 is a sectional view taken along the same line as in FIG. 18 and illustrates a fifth embodiment of a door latch device according to the present invention. In the fifth embodiment of the door latch device, an outside lever 50 is longer so that the inner end extends slightly inward of the vehicle. In a facing portion 202*a* of the second casing 202 across the inner end 505 of the outside lever 50, there is formed an engagement hole 57 through which the inner end 505 of the outside lever 50 passes. As shown by two-dotted lines in FIG. 23, if the outside lever 50 moves inward of the vehicle by impact, the inner end 505 goes into the engagement hole 57 of the second casing 202 to prevent the outside lever 50 from turning in the releasing direction. The engagement hole 57 of the second casing 202 acts as a stopper in this invention.

Figure 24:
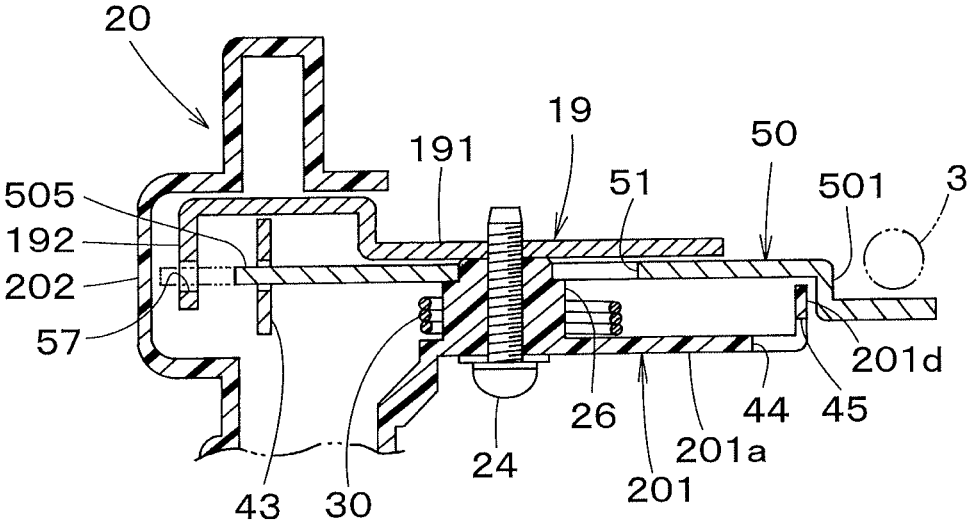
FIG. 24 is a horizontal sectional view of a sixth embodiment of a door latch device according to the present invention, at the same position as FIG. 20.

FIG. 24 is a sectional view of a sixth embodiment of a door latch device according to the present invention, taken along the same line in FIG. 18. In the sixth embodiment of the door latch device, the back plate 19 is bent not to contact the release lever 43 and extends inward of the vehicle. A facing portion 192 across an inner end 505 of the outside lever 50 is integrally formed, and in the facing portion 192, there is formed an engagement hole 57 through which the inner end 505 of the outside lever 50 passes. As shown by two dotted lines in FIG. 24, if the outside lever 50 moves inward of the vehicle by impact, the inner end 505 goes into the engagement hole 57 of the facing portion 192 to prevent the outside lever 50 from turning in a releasing direction. The engagement hole 57 in the facing portion 192 acts as a stopper in this invention.

The facing portion 202*a*, 192 in the fifth and sixth embodiments may be formed in any one of the body 134 and cover member 18.

As mentioned above, in the third through sixth embodiments, another relatively easy stopper may be provided in the back member 19 or first casing 201 to prevent the outside lever 50 from turning in a releasing direction if the door 2 is deformed inward of the vehicle, thereby enhancing reliability of the door latch device.

In the third embodiment, the engagement portion 53 is provided on the back member 53. For example, if the back member 19 is omitted, as shown by two-dotted lines in FIG. 19, the body 13 and cover member 18 extend downward, and the engagement portion 53 may be provided on the extension. One of the body 13 and cover member 18 may extend downward, and the engagement portion 53 may be provided in the extension.

The stopper for preventing the outside lever 50 in a releasing direction is not limited in the foregoing embodiments, but any shape may be used if the outside lever 50 in the usual position is allowed to turn in a releasing direction and if the outside lever 50 which moves inward of the vehicle is prevented from turning in the releasing direction. A stationary member may be provided with the outside lever 50.

The upward arm 301 of the torsion spring 30 is employed as biasing means for biasing the outside lever 30 outward anytime, but biasing means such as a tension coil spring may be used.

The guide member 37 in FIG. 10 may be employed as means for biasing the outside lever 50 anytime, and is not shown.

A seventh embodiment of a door latch device according to the present invention will be described with respect to FIGS. 25 to 31. The same numerals are allotted to the same elements as those in the first through sixth embodiments, and detailed description thereof is omitted.

Figure 26:
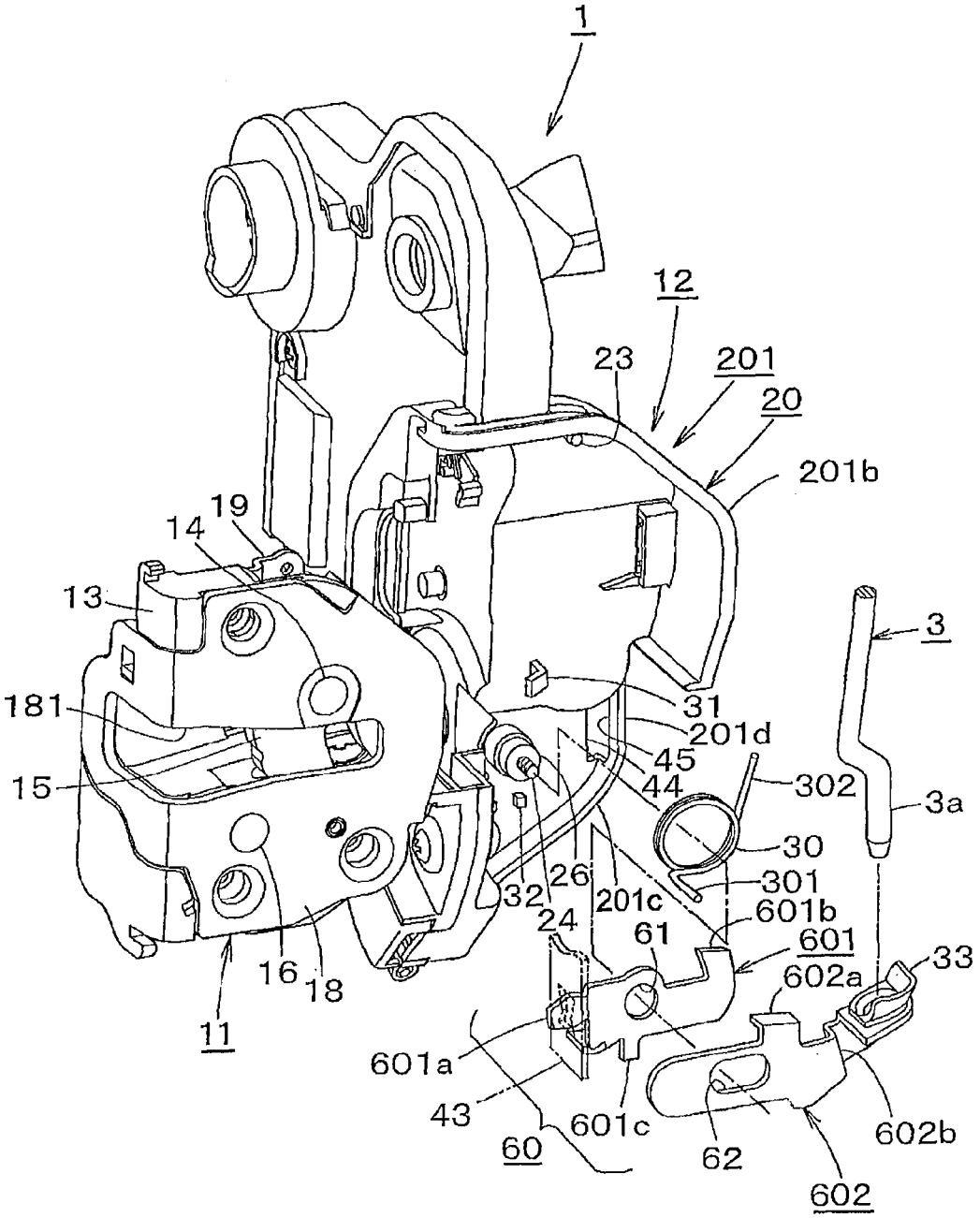
FIG. 26 is an exploded perspective view of the same.
Figure 27:
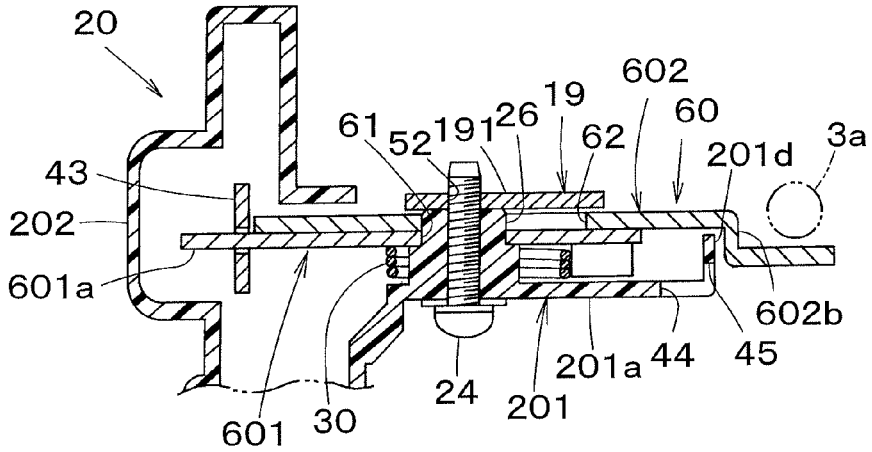
FIG. 27 is a horizontal sectional view taken along the line XXVII-XXVII in FIG. 25.
Figure 28:
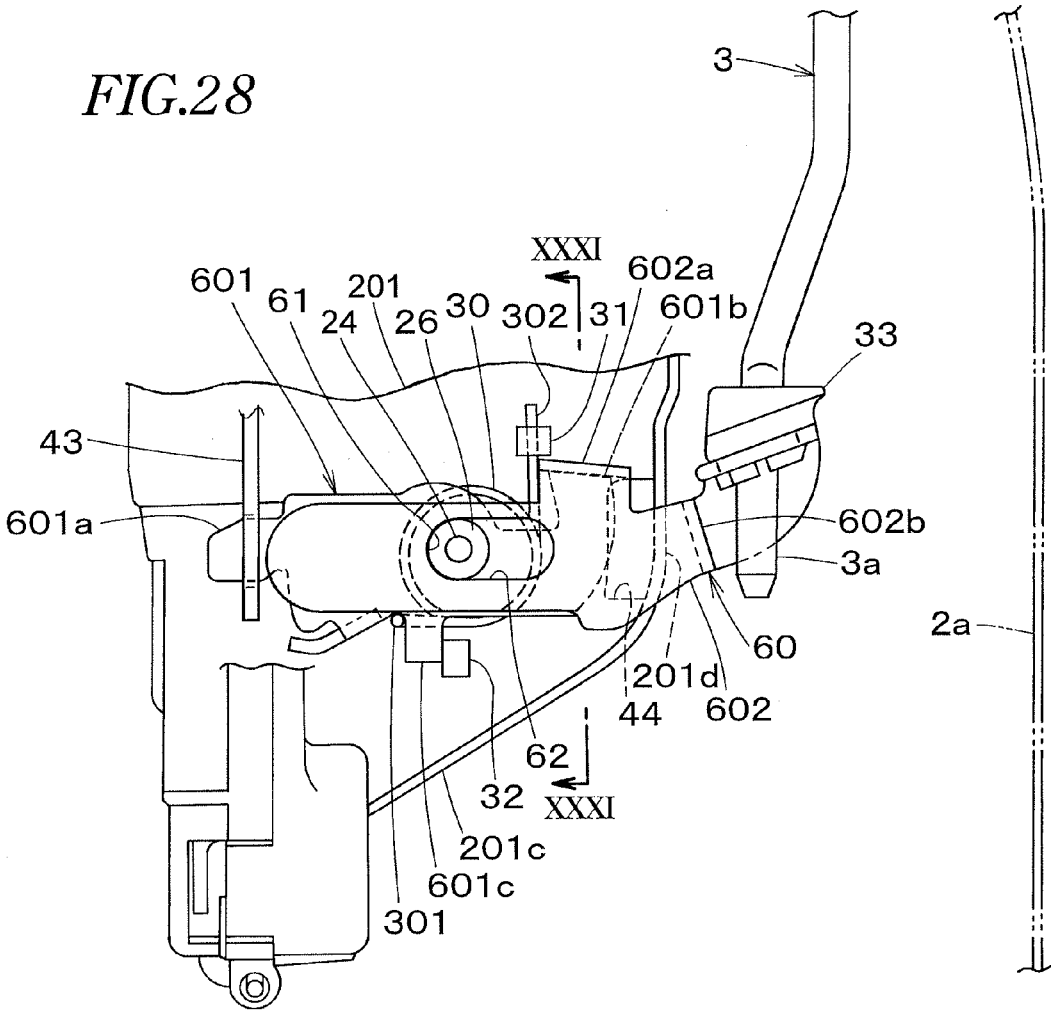
FIG. 28 is an enlarged view of an outside-lever mounting portion of the same.

In FIGS. 26-28, an outside lever 60 in this embodiment extends transversely of the vehicle, and comprises a first outside lever 601 having a shank hole 61 in the middle and a second outside lever 602 having an elongate hole 62. The second outside lever 602 will be described in detail later and also acts as a door-deformation following lever or a door-deformation following member in which the second outside lever 602 is moved inward of the vehicle if the outer panel 2*a* of the door 2 is deformed inward of the vehicle, whereby the release lever 43 is moved in a direction in which rotation of the outside lever 60 in a releasing direction is not transmitted to the engagement portion so that the latch 15 cannot disengage from the ratchet. In the following description, the second outside lever 602 is called "door-deformation following lever".

The shank hole 61 of the first outside lever 601 engages with the pivot shaft 26 of the first casing 201. The door-deformation following lever 602 is disposed on the back surface of the first outside lever 601 and the elongate hole 62 moves with respect to and turns about the pivot shaft 26. The door-deformation following lever 602 relatively moves with respect to the first outside lever 691 transversely of the vehicle. The pivot shaft 26 engages in the shank hole 61 of the first outside lever 601 and in the elongate hole 62 of the door-deformation following lever 602. Thereafter, a lower part 191 of the back plate 19 engages with the pivot shaft 26 by engaging the bolt 24 in an internal thread 52 in FIG. 27.

The door-deformation following lever 602 is longer than the first outside lever 601. When the pivot shaft 26 is in contact with the edge of the elongate hole 62 and when the door-deformation following lever 602 is the usual position in FIG. 25, an outward side of the door-deformation following lever 602 projects from the right side of the first casing 201 toward the outside of the vehicle, and the inner end of the door-deformation following lever 602 is slightly spaced from the release lever 43 connected to an inner end 601*a* of the first outside lever 601 in FIG. 28.

Figure 30:
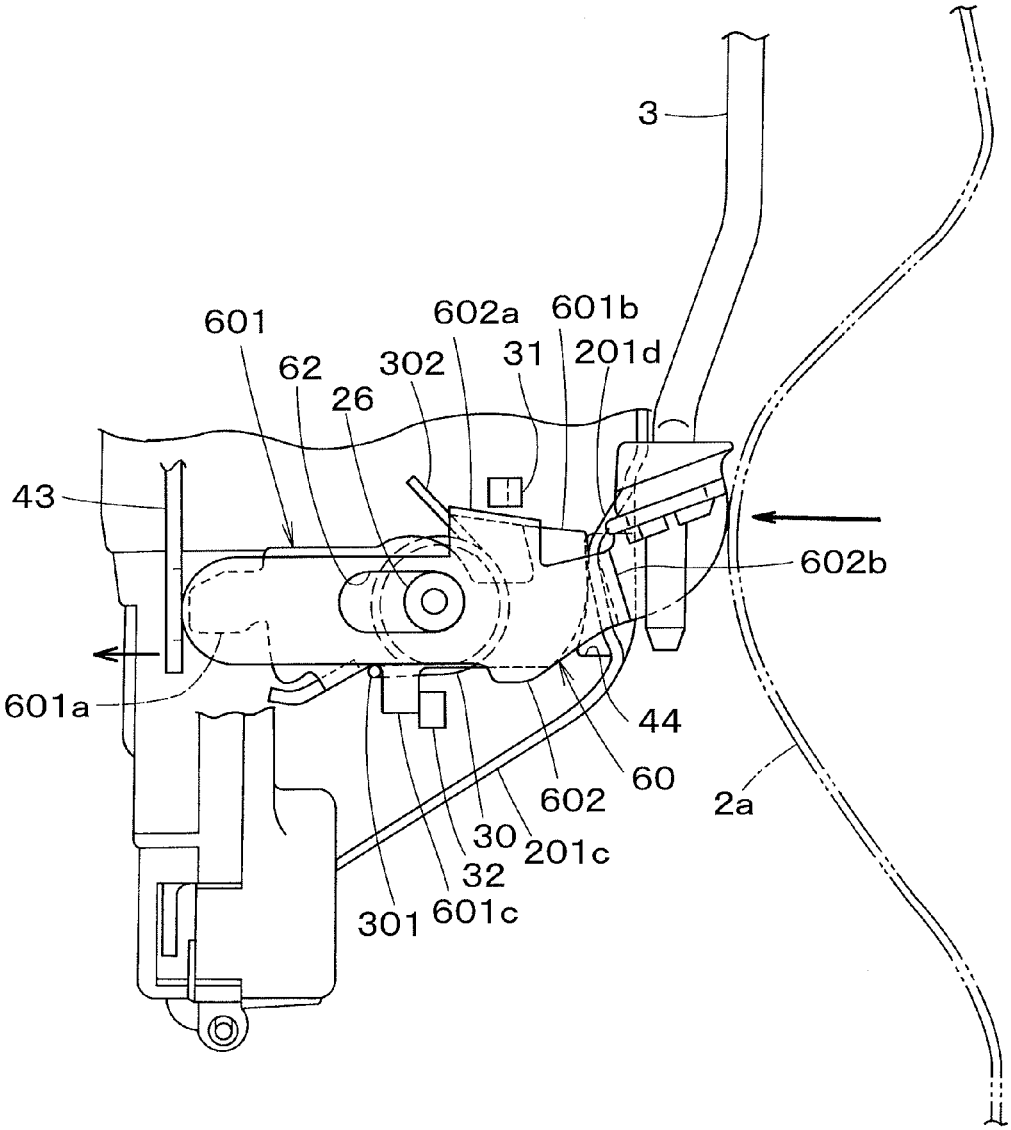
FIG. 30 is an enlarged view showing motion of a door-deformation following lever by impact.
Figure 31:
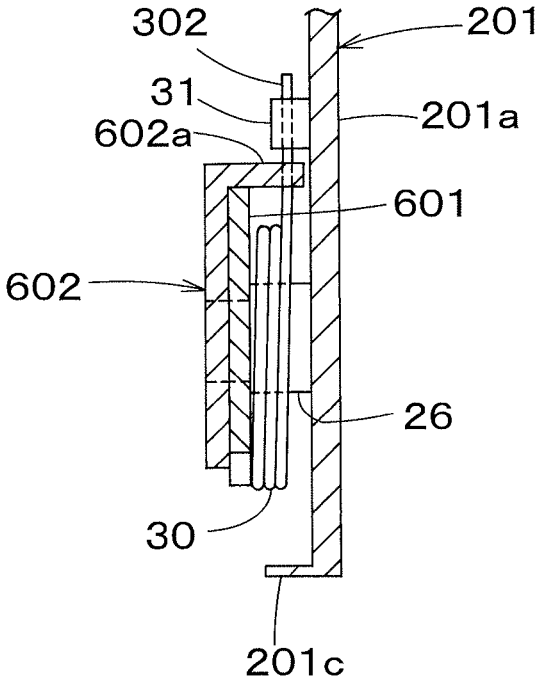
FIG. 31 is a vertical sectional view taken along the line XXXI-XXXI in FIG. 28.
Figure 32:
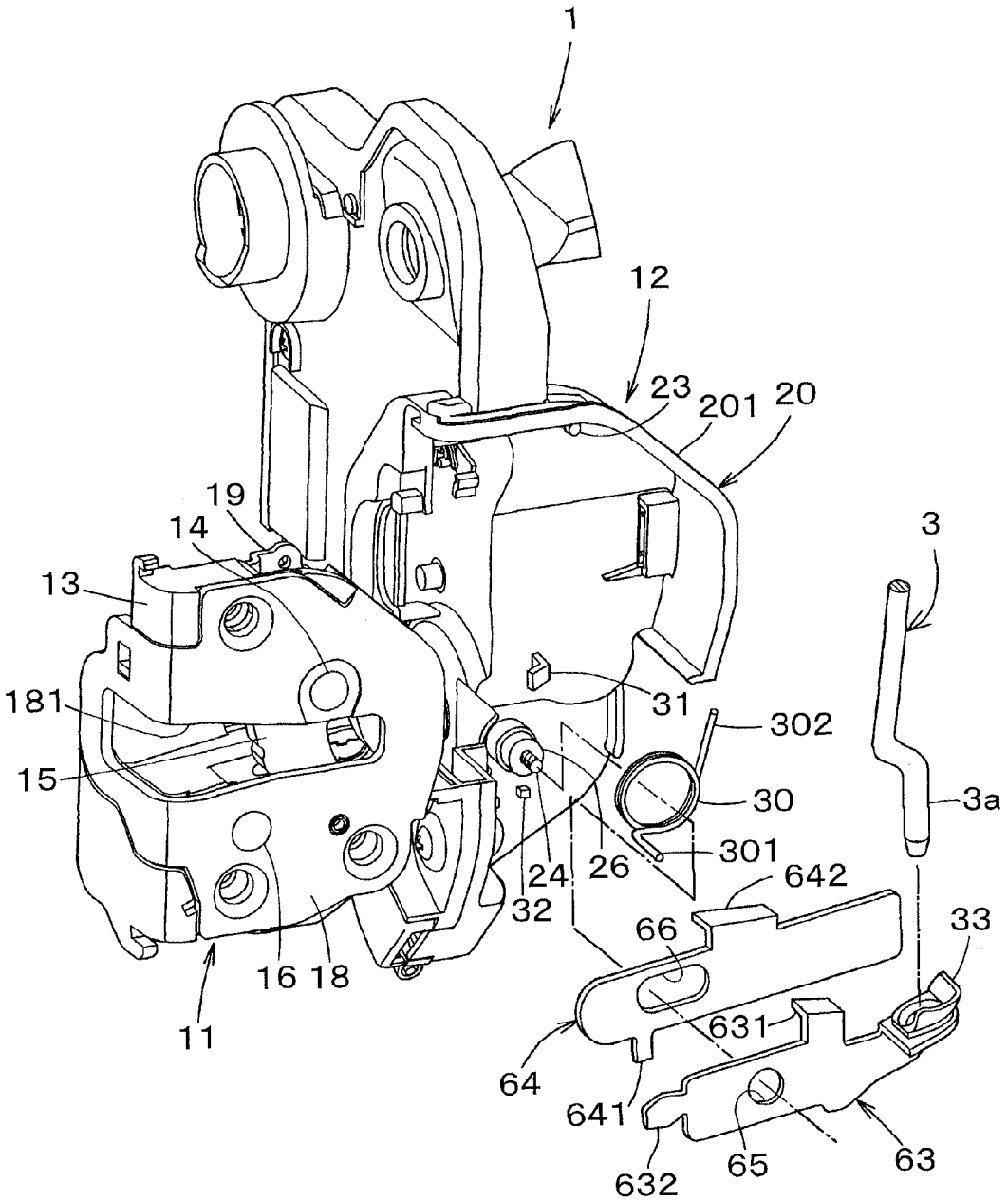
FIG. 32 is an exploded perspective view of a eighth embodiment of a door latch device according to the present invention.

If the pivot shaft 26 comes in contact with an outer edge of the elongate hole 62 to move the door-deformation following door 602 toward the inside of the vehicle maximally, the inner side end of the door-deformation following lever 602 slightly projects toward the inside of the vehicle and the release lever 43 is released from the inner end 601*a* of the first outside lever 601 in FIG. 30.

At the outer end of the first outside lever 601 facing the outer panel 2*a*, there is formed an engaged projection 601*a*, and there is formed an engaged projection 601*b* in which the upper end is tilted to match an engagement projection 602*a* (later described) of the door-deformation following lever 601. At the lower end of the first outside lever 601 slightly inward of the shank hole 61, there is formed a downward engagement portion 601*c* for engaging one arm 301 of the torsion spring (later described).

In the middle of the upper end of the door-deformation following lever 602, there is formed an L-shaped engagement projection 602*a* which is tangentially tilted on a turning path of the door-deformation following lever 602. In this embodiment, even if the door-deformation following lever 602 is moved maximally transversely of the vehicle, the lower surface of the engagement projection 602*a* comes in contact with the upper surface of the engaged projection 601*b* of the first outside lever 601 thereby pivoting the first outside lever 601 together with the door-deformation following lever 602 in a releasing direction in FIGS. 28 and 29. When the door-deformation following lever 602 moves toward the inside of the vehicle maximally, the engagement projection 602*a* may take off the upper surface of the engaged projection 601*b* of the first outside lever 601 thereby pivoting only the door-deformation following lever 602 clockwise.

The outer end of the door-deformation following lever 602 projecting from a lower side wall is bent like "L" toward the lower side wall 201*c*, and the inner surface of the bent portion 602*b* is close to the outer surface of the weaker portion 201 of the lower side wall 201*c*.

To a receipt member 33 at the outer end of the door-deformation following lever 602 (facing the outer panel 2*a*)

is connected a crank-like portion 3*a* at the lower end of the motion-transmitting member 3.

An arm 301 of the torsion spring 30 about the pivot shaft 26 engages with an engagement portion 601*c* of the first outside lever 601, and an upward arm 302 engages with an engagement projection 31 on the back surface of the base 201 of the first casing 201. The arm 301 which engages with the engagement portion 601*c* of the first outside lever 601 projects backward from the lower end of the door-deformation following lever 602.

Figure 25:
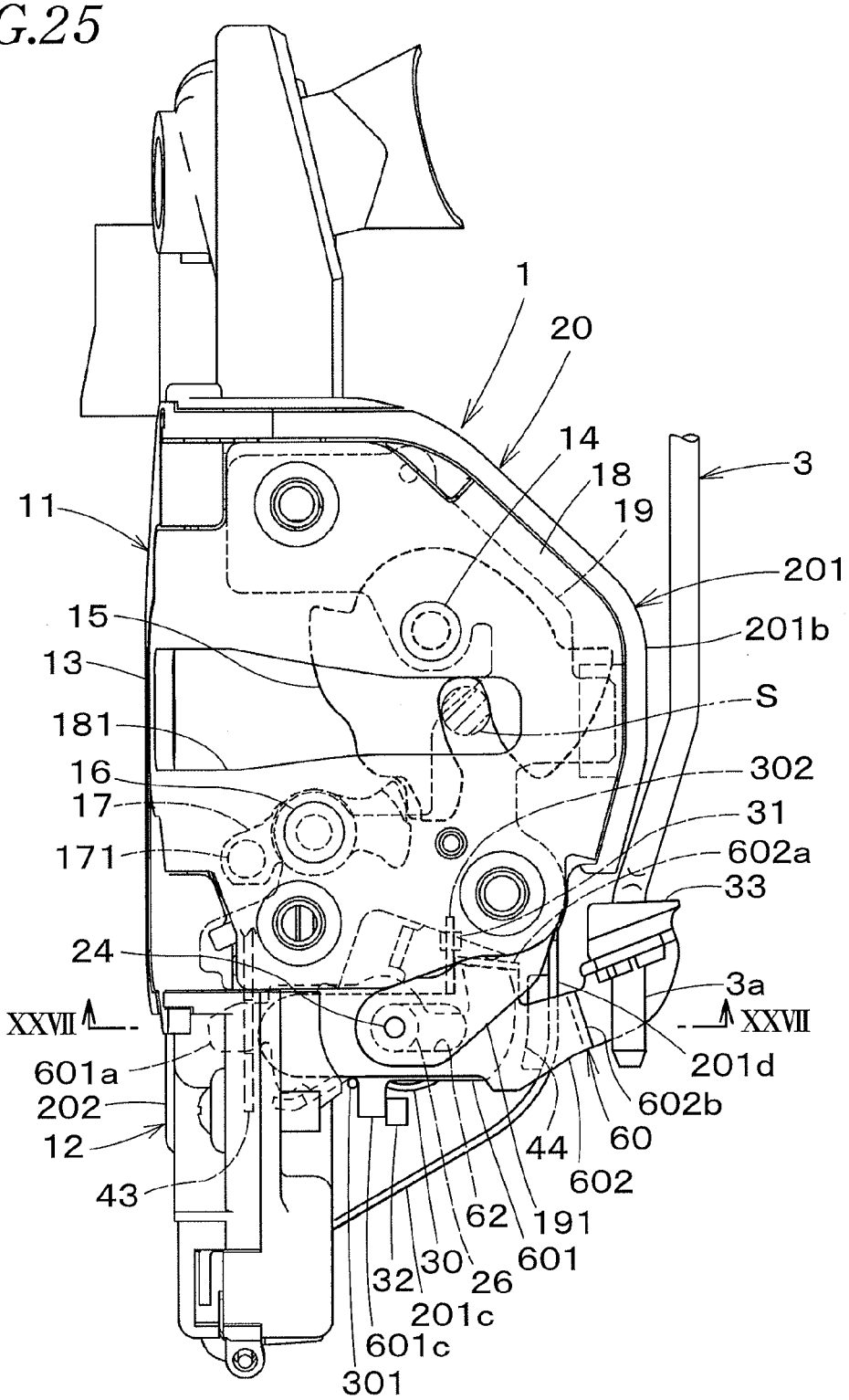
FIG. 25 is a front elevational view of a seventh embodiment of a door latch device according to the present invention viewed from back of a vehicle.

Thus, the first outside lever 601 is biased about the pivot shaft 26 counterclockwise in FIG. 25. The upper end of the engaged projection 601*b* of the first outside lever 601 comes in contact with the lower surface of the engagement projection 602*a* of the door-deformation following lever 602. Hence, the door-deformation following lever 602 is biased about the pivot shaft 26 counterclockwise with the first outside lever 601. The whole outside lever 60 is biased by the torsion spring 30 counterclockwise. The outer side edge of the engagement portion 601*c* of the first outside lever 601 is in contact with the inner side edge of the stopper 32 of the base 201*a* of the first casing 201, and the whole outside lever 60 is held in the usual position in FIGS. 25 and 28.

Figure 29:
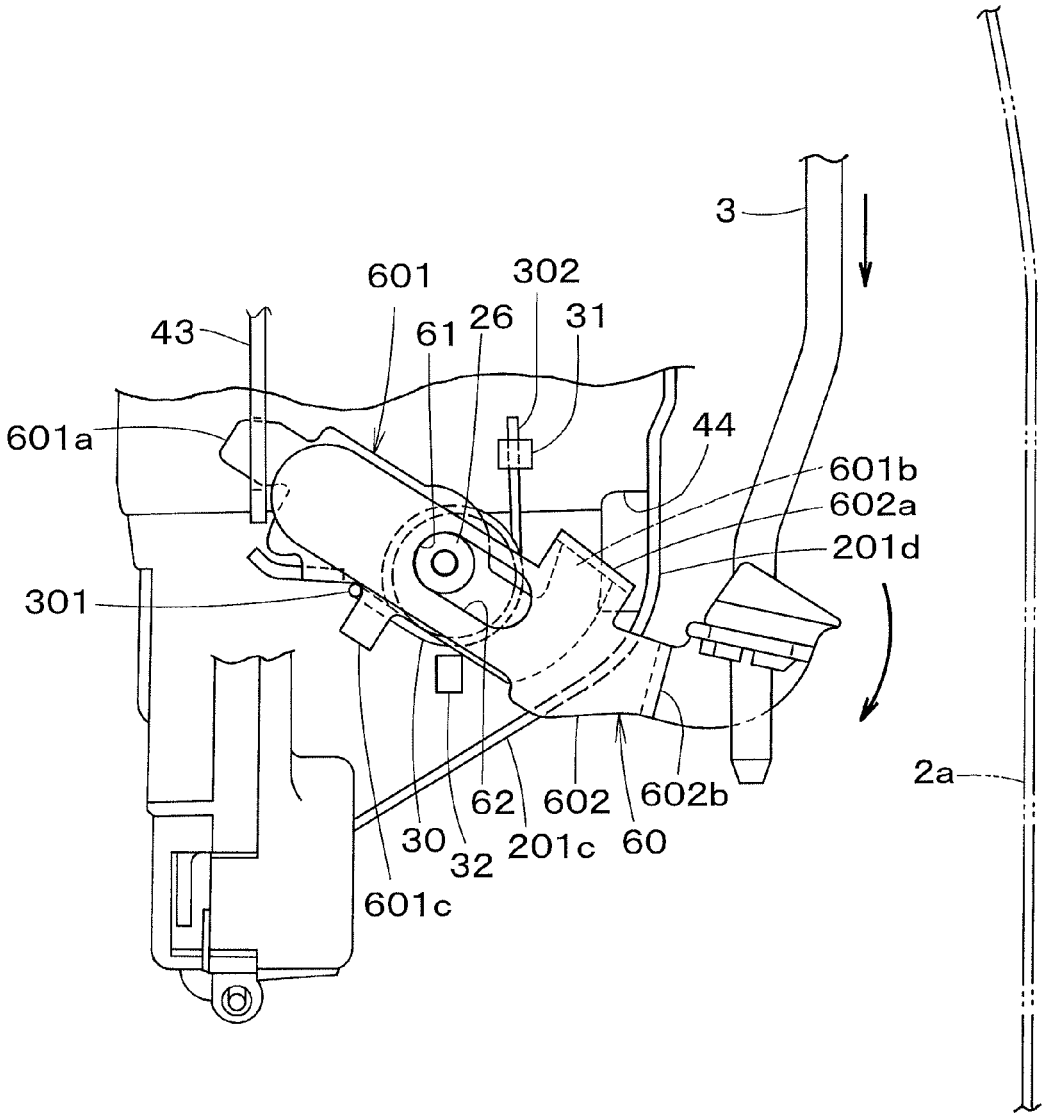
FIG. 29 is an enlarged view when the outside lever turns in a releasing direction in a usual state.

FIGS. 28 and 29 illustrate a usual state of the door latch device 1 in which the door is closed. The outside handle 4 is actuated to open the door, and the motion-transmitting member 3 connected thereto is moved downward. In FIG. 29, the whole outside lever 60 which comprises the door-deformation following lever 602 and the first outside lever 601 connected to the engagement projection 602 on the engaged projection 601*b* turns in a releasing direction or counterclockwise in FIG. 28 from the usual position in which the door is closed in FIG. 28 to the operating position in which the door is open in FIG. 29.

When the lock knob is the unlocking state and when the locking lever and release lever 43 are in the unlocking position, the release lever 43 in which the inner end 601 *a* of the first outside lever 601 engages moves upward and comes in contact with the ratchet pin 171 from below. Hence, the ratchet 17 disengages from the latch 15 and the door 2 can be opened.

In the usual state in FIG. 28, as mentioned above, the door-deformation following lever 602 is pushed by a force of the arm 302 of the torsion spring 30 anytime toward the outside of the vehicle. The lower surface of the engagement projection 602*a* is in contact with the upper surface of the engaged projection 601*b* of the first outside lever 601. Even if the door-deformation following lever 602 is moved transversely of the vehicle maximally, the first outside lever 601 and door-deformation following lever 602 function as the whole outside lever 60.

In FIG. 30, if the outer panel 2*a* of the closed door 2 is deformed toward the inside of the vehicle by impact and the outside lever 60 is exerted by impact, the door-deformation following lever 602 with the elongate hole 62 about the pivot shaft 26 moves toward the inside of the vehicle with respect to the first outside lever 601 against the force of the torsion spring 30 and stops when the pivot shaft 26 comes in contact with the side edge of the elongate hole 62 nearer to the outside of the vehicle. Even if the door-deformation following lever 602 moves toward the inside of the vehicle maximally, the engagement projection 602*a* is in contact with the engaged projection 601*b* of the first outside lever 601, and the door-deformation following lever 602 moves toward the inside of the vehicle in a nearly horizontal state.

The door-deformation following lever 602 moves with deformation of the outer panel 2*a*, and the bent portion 602*b* comes in contact with the lower side wall 201*c* of the first casing 201. At a part of the lower side wall 201*c* facing the pivot shaft 26, the weaker portion 201*d* is provided. Thus, if the strong impact exerts onto the door-deformation following lever 602, the door-deformation following lever 602 can move while the bent portion 602*b* deforms the weaker portion 201*d* inward. If impact is not so strong against the door-deformation following lever 602 not to cause deformation of the weaker portion 201*d*, the door-deformation following lever 602 does not move toward the inside of the vehicle, and the door latch device 1 is held in the usual state where the door 2 is closed.

If the door-deformation following lever 602 moves toward the inside of the vehicle maximally, the inner side end of the door-deformation following lever 602 projects from the inner end 601*a* of the first outside lever 601 toward the inside of the vehicle. Thus, the release lever 43 coupled to the inner end 601*a* of the first outside lever 6 is pushed by the inner end of the door-deformation following lever 602 and released from the inner end 601*a*, thereby releasing the connection with the inner end 601*a* of the first outside lever 601. Due to deformation of the outer panel 2*a*, impact exerts onto the motion-transmitting member 3, and the door-deformation following lever 602 is pressed via the motion-transmitting member 3 toward the inside of the vehicle, thereby releasing the connection as well.

The inner end 601*a* of the first outside lever 601 is disconnected from the release lever 43. In FIG. 30, the outer panel 2*a* is further deformed in a direction in which the door-deformation lever 602 turns downward. Even if the first outside lever 601 and door-deformation following lever 602 turn in a releasing direction or clockwise, its motion is not transmitted to the release lever 43. Thus, the release lever 43 does not move upward, and the ratchet 17 does not disengage from the latch 15. The latch 15 still engages with the striker S thereby preventing the door 2 from opening accidentally.

FIGS. 31 to 35 illustrates an eighth embodiment of a door latch device according to the present invention. The same numerals are allotted to the same elements as those in the seventh embodiment, and detailed description thereof is omitted.

The eighth embodiment differs from the seventh embodiment at a point that a door-deformation following lever 64 separate from an outside lever 63 is provided.

The outside lever 63 is longer than the second outside lever 602. The outside lever 63 has a shank hole 65 about the pivot shaft 26 and a receipt member 33 in which a bent portion 3*a* of the motion-transmitting member 3 fits.

Between the shank hole 65 and the receipt member 33, there is formed an L-shaped engagement projection 631 tilted tangentially on a turning path of the outside lever 63 at the upper end of the outside lever 63. With an inner end 632 of the outside lever 63 is engaged the lower end of the release lever 43.

The door-deformation following lever 64 is longer than the outside lever 63. In the outside lever 63, there is formed an elongate hole 66 which can turn about the pivot shaft 26 and can move transversely of the vehicle. At the lower edge of the door-deformation following lever 64 below the elongate hole 66, an engagement portion 641 for engaging an arm 301 of the torsion spring 30 projects downward. On the upper edge in the middle of the door-deformation following lever 64, an engaged projection 642 is tilted to correspond to an engagement projection 631 of the outside lever 63, and the lower surface of the engagement projection 631 is in contact with the upper surface of the engaged projection 642. The engagement projection 642 is longer than the engaged projection 631 so that the engagement projection 631 of the outside lever 63 does not take off the engaged projection 642 even if the door-deformation following lever 64 moves transversely of the vehicle maximally.

Figure 33:
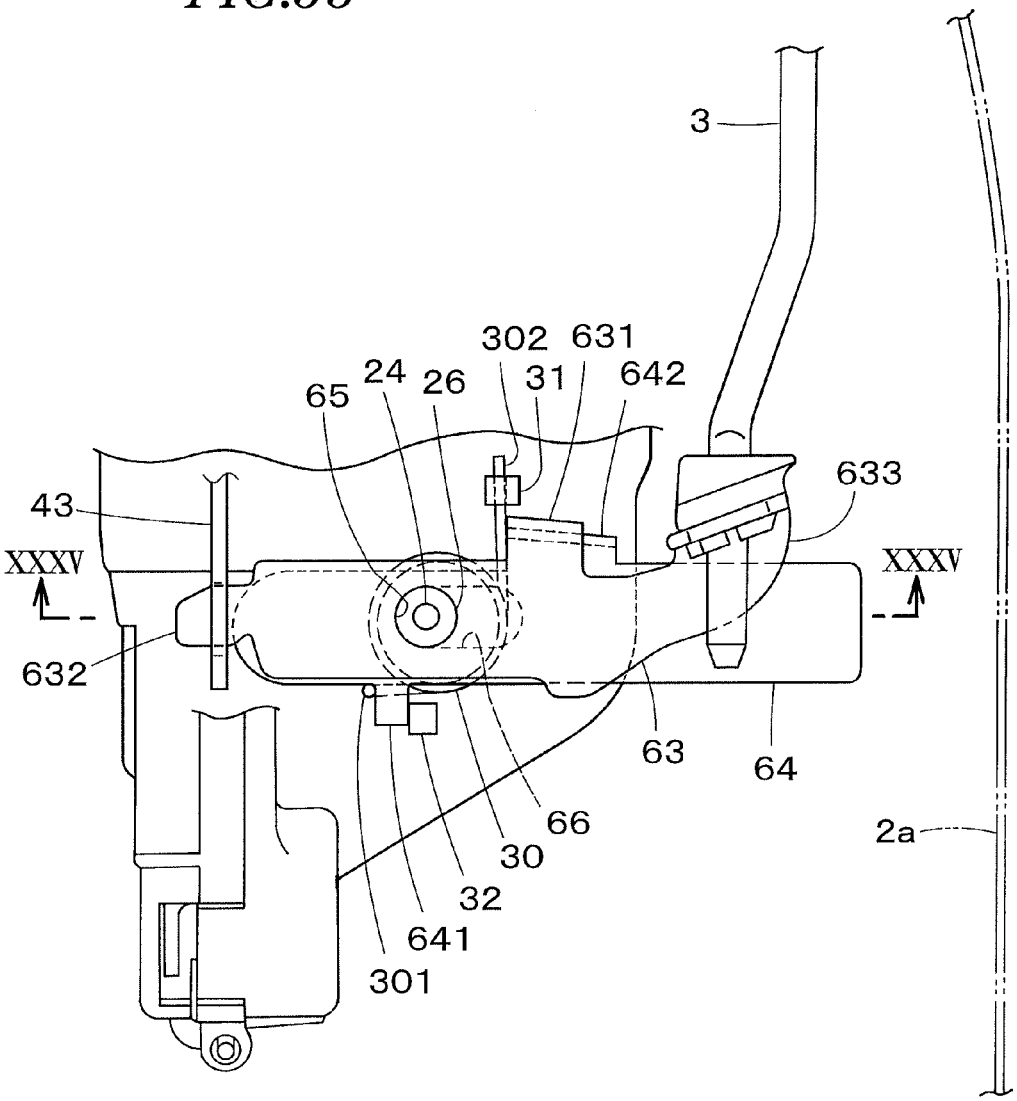
FIG. 33 is an enlarged view of an outside-lever mounting portion of the same.

In FIG. 33, the other upward arm 302 of the torsion spring 30 engages with an engagement projection 31 of the first casing 201 similar to the seventh embodiment. The other arm 302 of the torsion spring 30 is in contact with the inner end of the engagement projection 631 of the outside lever 63 and engaged projections 64 of the door-deformation following lever 64.

The lower surface of the engagement portion 631 of the outside lever 63 is in contact with the upper surface of the engaged projection 642 of the door-deformation following lever 64, so that the outside lever 63 and door-deformation following lever 64 are biased by a force of the torsion spring 30 and pivoted together in a releasing direction.

Figure 35:
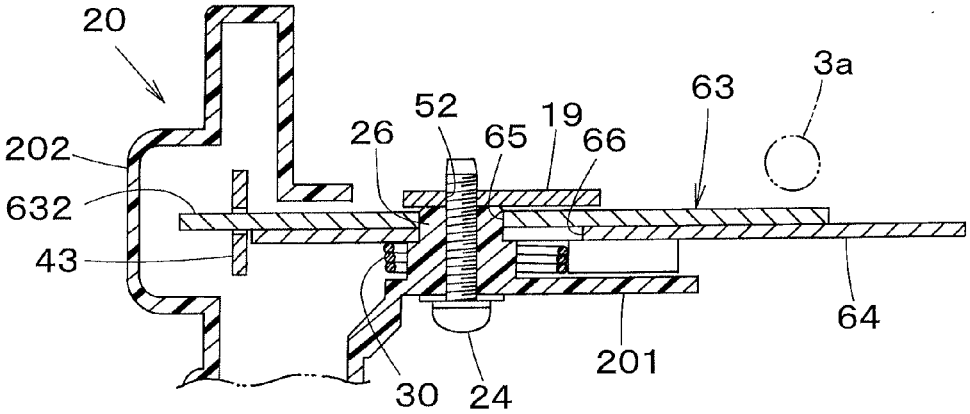
FIG. 35 is a horizontal sectional view taken along the line XXXV-XXXV in FIG. 33.

In FIGS. 33 and 35, an inner opening edge of the door-deformation following lever 64 comes in contact with the pivot shaft 26, and the door-deformation following lever 64 moves toward the outside of the vehicle maximally. The outer side end of the door-deformation following lever 64 projects from an outer side end 633 of the outside lever 63 toward the outside of the vehicle, and the inner side end of the door-deformation following lever 64 is slightly spaced so as not to contact the release lever 43 which engages with an inner side end 632 of the outside lever 63.

Figure 34:
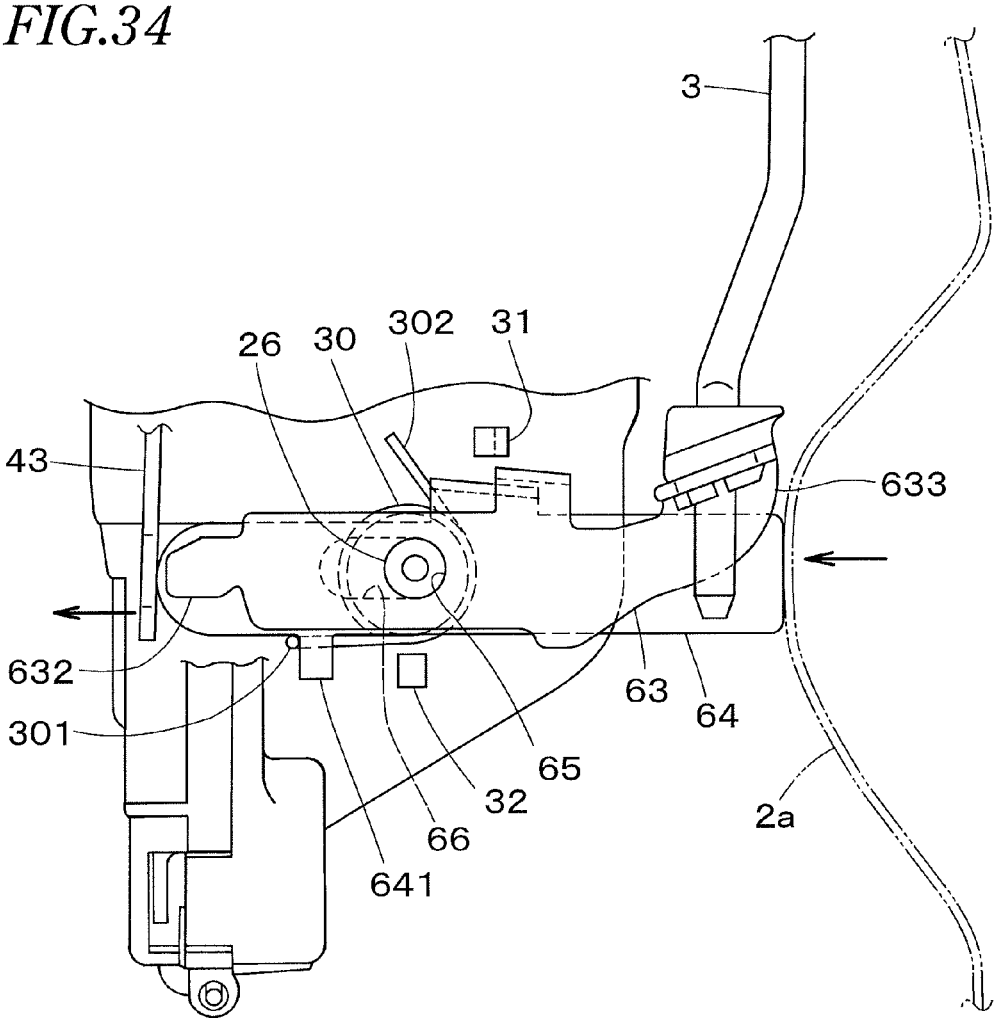
FIG. 34 is an enlarged view showing motion of a door-deformation following lever by impact.

In FIG. 34, an outer opening edge of the elongate hole 66 comes in contact with the pivot shaft 26 and the door-deformation following lever 64 moves toward the inside of the vehicle. The inner side end of the door-deformation following lever 64 slightly projects from the inner side end of the outside lever 63. The inner side end 632 of the outside lever 63 disengages from the release lever 43.

The operation of the door latch device 1 in the eighth embodiment, particularly motion of the door-deformation following lever 54, will be described when the side of the vehicle is impacted.

FIG. 33 illustrates a usual state or door-closed state of the door latch device. When the outside handle 4 is operated to open the door, the motion-transmitting member 3 connected thereto moves down. The outside lever 63 and door-deformation following lever 64 turns at a certain angle in a releasing direction or clockwise in FIG. 33 against a force of the torsion spring 30.

When the lock knob is in a locking state and when the locking lever and release lever 43 is in an unlocking state, the release lever 43 which engages with the inner side end 632 moves upward and comes in contact with the ratchet pin 171 to disengages the ratchet 17 from the latch 15. Thus, the door 2 can be opened.

In the usual state in FIG. 33, as mentioned above, the lower surface of the engagement projection 631 of the outside lever 63 is in contact with the upper surface of the engaged projection 642 of the door-deformation following lever 64. Hence, the outside lever 63 and door-deformation following lever 64 turn together in the releasing direction.

In FIG. 34, when the door 2 is closed, the outer panel 2*a* of the door 2 is deformed by impact, which is applied to the door-deformation following lever 64 which projects toward the outside of the vehicle from the outer end of the outside lever 63. The door-deformation following lever 64 pivotally mounted about the pivot shaft 26 in the elongate hole 66 moves toward the inside of the vehicle against the force of the torsion spring 30 and stops when the pivot shaft 26 comes in contact with the outer edge of the elongate hole 66. Even when the door-deformation following lever 64 moves toward the inside of the vehicle maximally, the engaged projection 642 is in contact with the engagement projection 631 of the outside lever 63. Hence, the door-deformation following lever 64 moves toward the inside of the vehicle in an approximately horizontal state.

The door-deformation following lever 64 follows the deformation of the outer panel 2*a* and moves toward the inside of the vehicle maximally. The inner side end of the door-deformation following lever 64 projects from the inner side end 632 of the outside lever 63 toward the inside of the vehicle. Thus, the release lever 43 coupled to the inner side end 632 of the outside lever 63 is pushed out toward the inside of the vehicle with the inner side end of the door-deformation following lever 64, and disengages from the inner side end 632 of the outside lever 63.

The outside lever 63 disengages from the release lever 43. In FIG. 34, even if the outer panel 2*a* is further deformed to turn the outside lever 63 and door-deformation following lever 64 downward in a releasing direction, its motion will not be transmitted to the release lever 43. Thus, similar to the seventh embodiment, the ratchet 17 does not disengage from the latch 15 because the release lever 43 does not move up, thereby preventing the door 2 from opening accidentally.

Figure 36:
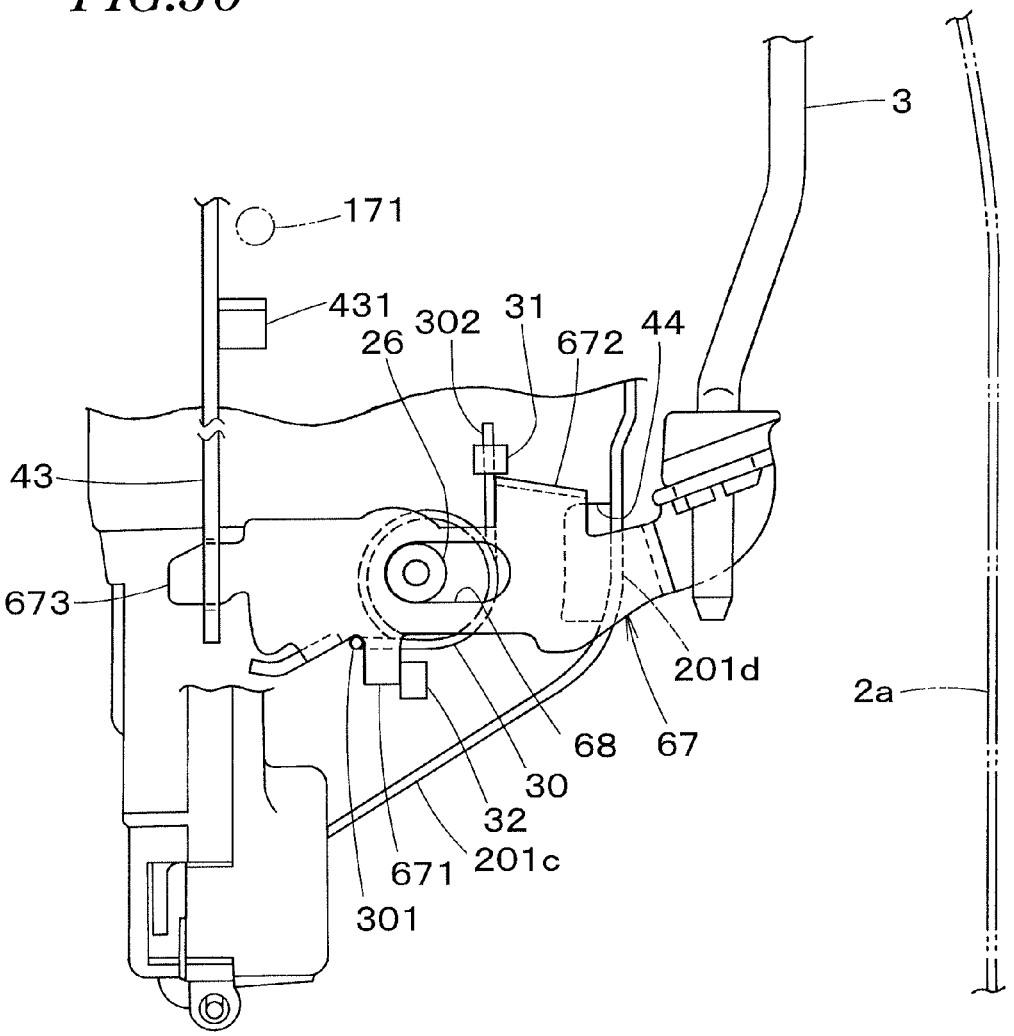
FIG. 36 is an enlarged view of an outside-lever mounting portion of a door latch device according to the present invention.
Figure 37:
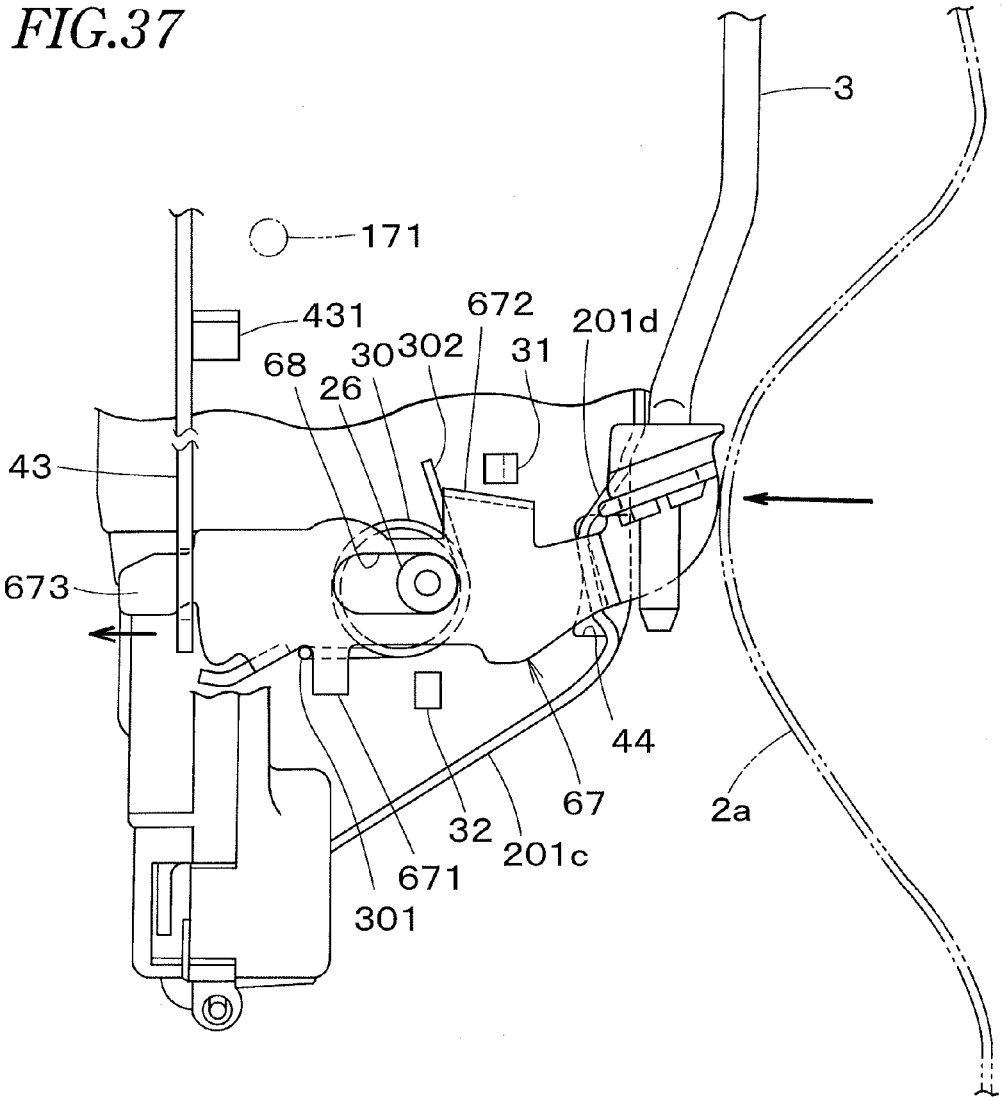
FIG. 37 is an enlarged view showing motion of an outside lever by impact.

FIGS. 36 and 37 illustrate a ninth embodiment of a door latch device according to the present invention. The same numerals are allotted to the same elements as those on the foregoing embodiments. In the ninth embodiment, an elongate hole 68 in the middle of an outside lever 67 is in contact with the pivot shaft 26 of the casing 20 to turn vertically and move transversely of the vehicle, and the outside lever 67 itself acts as a door-deformation following member or a door-deformation following lever.

At the lower edge of the outside lever 67, there is formed an engagement projection 671 for engaging an arm 301 of the torsion spring 30. An outer side of the engagement portion 671 can come in contact with a stopper 32 of the casing 20. From the upper edge of the outside lever 67, an L-shaped engagement portion 672 projects upward, and the inner side of the engagement portion 672 is in contact with an upward arm 302 of the torsion spring 30 engaging with an engagement portion 31. Thus, the outside lever 67 is biased by the torsion spring 30 anytime toward the outside of the vehicle or a usual state in FIG. 36.

An inner side end 673 of the outside lever 67 is coupled to the lower end of the release lever 43 as well as in the foregoing embodiments. When the outside lever 67 is in the usual position in FIG. 36, a pushing portion 431 of the release lever 43 is positioned under the ratchet pin 171 to actuate the ratchet pin 171.

In the ninth embodiment of the door latch device, when the door 37 is closed in FIG. 37, an outer panel 2*a* of the door 2 is deformed by impact toward the inside of the vehicle. With the deformation, the outside lever 67 moves toward the inside of the vehicle, and the release lever 43 coupled to the inner side end 673 is moved as a whole toward the inside of the vehicle. The pushing portion 431 which can push the ratchet pin 171 is moved from the position in FIG. 36 toward the inside of the vehicle. It makes it impossible for the pushing portion 431 to push up the ratchet pin 171 in a door-opening direction for disengaging the ratchet 17 from the latch.

Thus, the outer panel 2*a* is further deformed to turn the outside lever 67 downward in a releasing direction. Even if the release lever 43 moves up, the ratchet pin 171 is unlikely to disengage from the latch 15 with the pushing portion 431, thereby preventing the door 2 from opening accidentally.

As mentioned above, in the door latch device of the seventh to ninth embodiments, if the outer panel 2*a* of the door 2 is deformed toward the inside of the vehicle, the door-deformation following lever 602, 64 and outside lever 67 themselves are moved in a direction for disabling the latch 15 and ratchet 17 to disengage from the striker S, to hold the door 2 closed thereby enhancing reliability of the door latch device.

Figure 38:
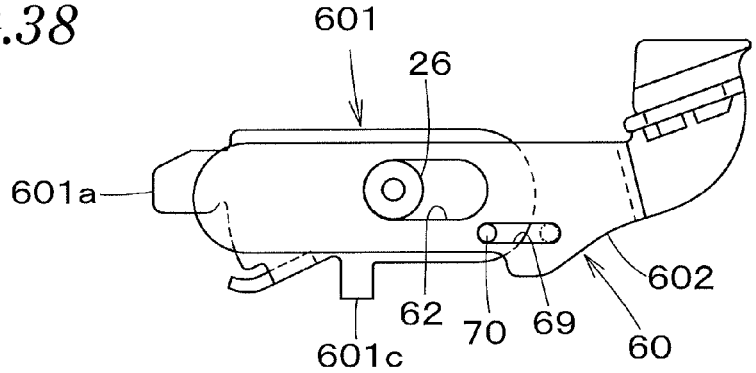
FIG. 38 is an enlarged view showing a variation of a connecting portion between a first outside lever and a door-deformation following lever.
Figure 39:
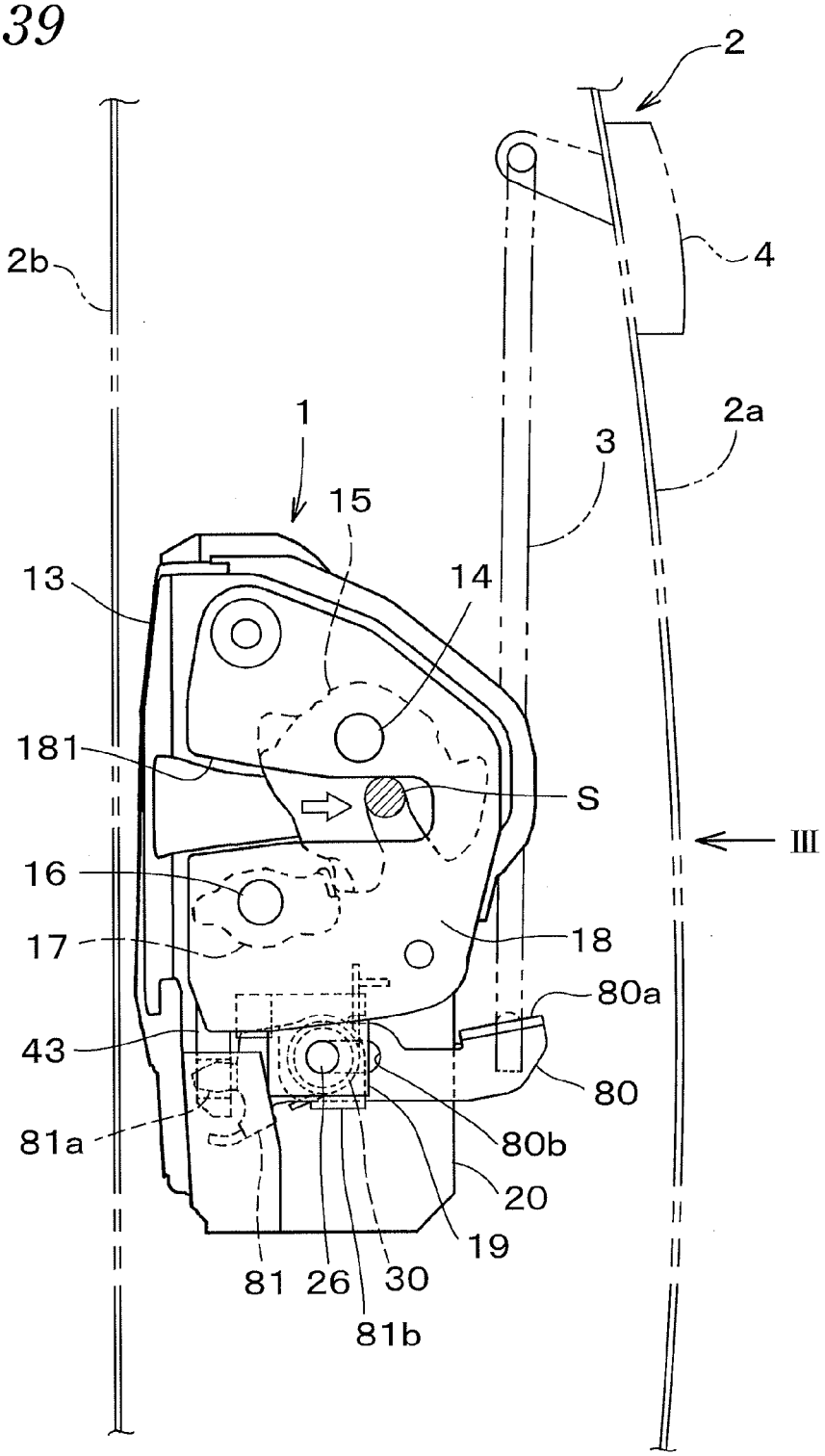
FIG. 39 is a front elevational view of a tenth embodiment of a door latch device according to the present invention.

In the seventh embodiment, the engaged portion 501*b* of the first outside lever 601 comes in contact with the engagement projection 602*a* of the door-deformation following lever 602 to move together in a releasing direction, but the means as shown in FIG. 38 may be employed. The casing 20 and torsion spring 30 are omitted.

An engagement hole 69 is formed at a position nearer to the outside of the vehicle than the elongate hole 62 transversely of the vehicle. The first outside lever 601 has no engaged projection 601*b*, but has an engagement pin 70 on the back surface nearer to the outside of the vehicle than the shank hole 61. The engagement pin 70 slides in and along the engagement hole 69 transversely of the vehicle. When the door-deformation following lever 601 is in the usual position in FIG. 38, the engagement pin 70 is positioned in the engagement hole 69 at an inner end toward the inside of the vehicle.

When the door is opened, the engagement hole 69 engages with the engagement pin 70, and the first outside lever 601 turns together with the door-deformation following lever 602 in a releasing direction. By impact, as shown by two dotted line, the engagement pin 70 relatively moves to the outer edge of the elongate hole 69. The door-deformation following lever 602 can move toward the inside of the vehicle with respect to the first outside lever 601. Without illustration, in a variation, opposite the foregoing, the engagement hole 69 and engagement pin 70 may be formed in the first outside lever 601 and door-deformation following lever 602 respectively. The outside hole 69 and engagement pin 70 may be formed in the outside lever 63 and on the door-deformation following lever 64 respectively in the eighth embodiment of the door latch device.

In the eighth embodiment, the door-deformation following lever 64 is in contact with the pivot shaft 26 to move transversely of the vehicle and to turn together with the outside lever 63. For example, without contacting the pivot shaft, the door-deformation following lever 64 may be supported by biasing with guide means of the first casing 201 to move only transversely of the vehicle and to make the outer end project outward from the right end of the outside lever 63 usually.

Furthermore, the door-deformation following lever 64 in the eighth embodiment may be connected to the outside lever in the ninth embodiment thereby enabling inward motion of the outer panel 2*a* and impact onto the motion-transmitting member 3 to be detected by the door-deformation following lever 64 and outside lever 67 respectively.

Without its illustration, the guide member 37 in FIG. 10 may be used as means for biasing the door-deformation following lever 602 in the seventh embodiment and the outside lever 67 in the ninth embodiment.

A tenth embodiment of a door latch device according to the present invention will be described with respect to FIGS. 39 to 48. The same numerals are allotted to the same elements as those in the first through ninth embodiments and its detailed description is omitted.

The door latch device 1 in the tenth embodiment comprises a synthetic-resin body 13 fixed to the rear face of an inner panel 2*b* in a door with bolts (not shown); a metal cover member 18 fixed to the inner panel with the body 13 to close the opening of the body 13; a metal back member 19 fixed to the front face of the body 13; and a synthetic-resin casing 20 fixed to the body 13 to cover various moving elements installed on the front face of the body 13. Those members correspond to a base member according to the present invention.

The door latch device 1 comprises a latch 15 pivotally mounted via a latch shaft 14 between the body 13 and the cover member 18 to engage with a striker S of a vehicle body; and a ratchet 17 which engages with an outer circumference of the latch 15 to prevent the latch 15 from turning. The latch 15 and ratchet 17 correspond to the engagement portion in this invention.

Figure 40:
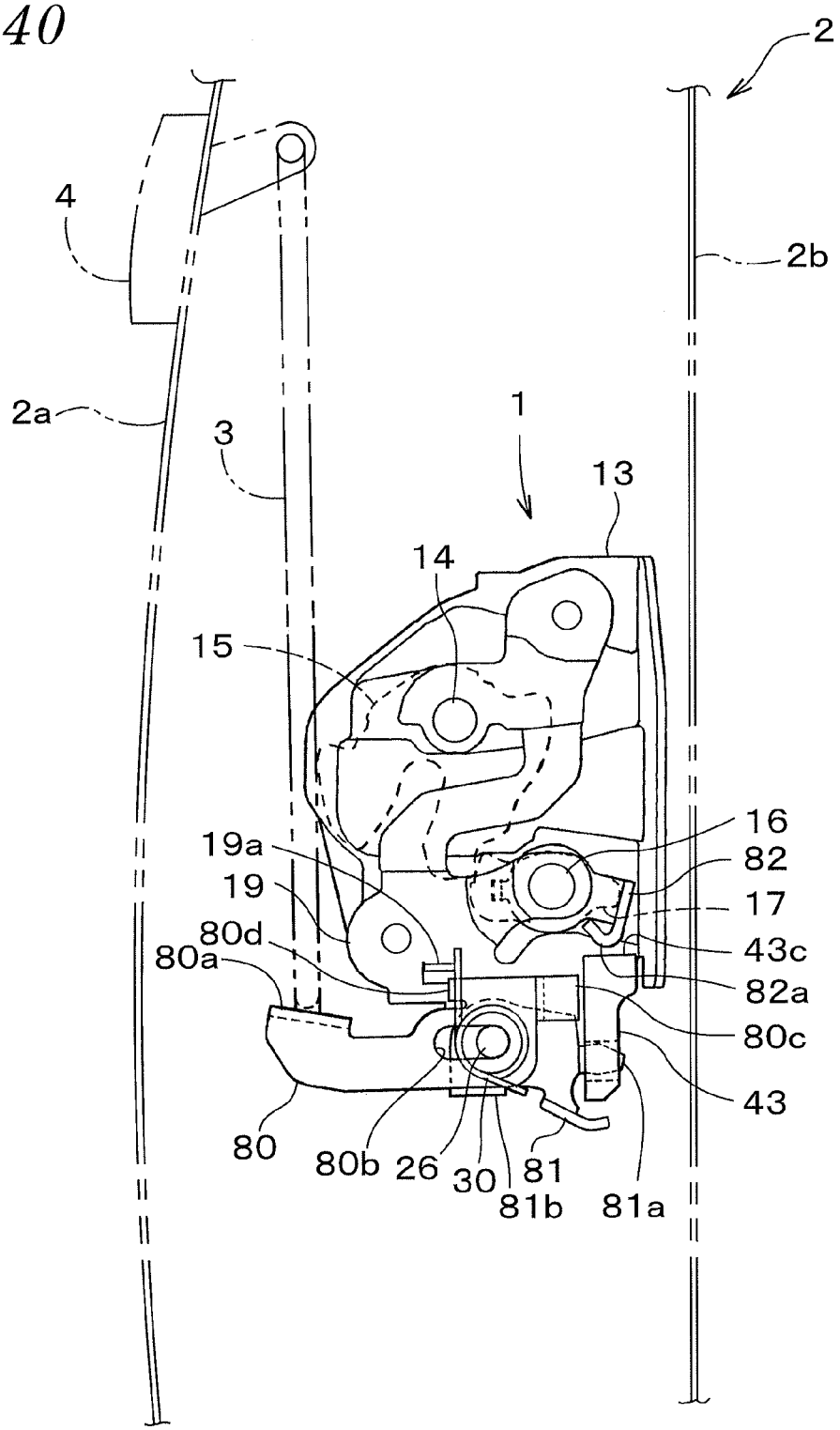
FIG. 40 is a back elevational view of the same.
Figure 41:
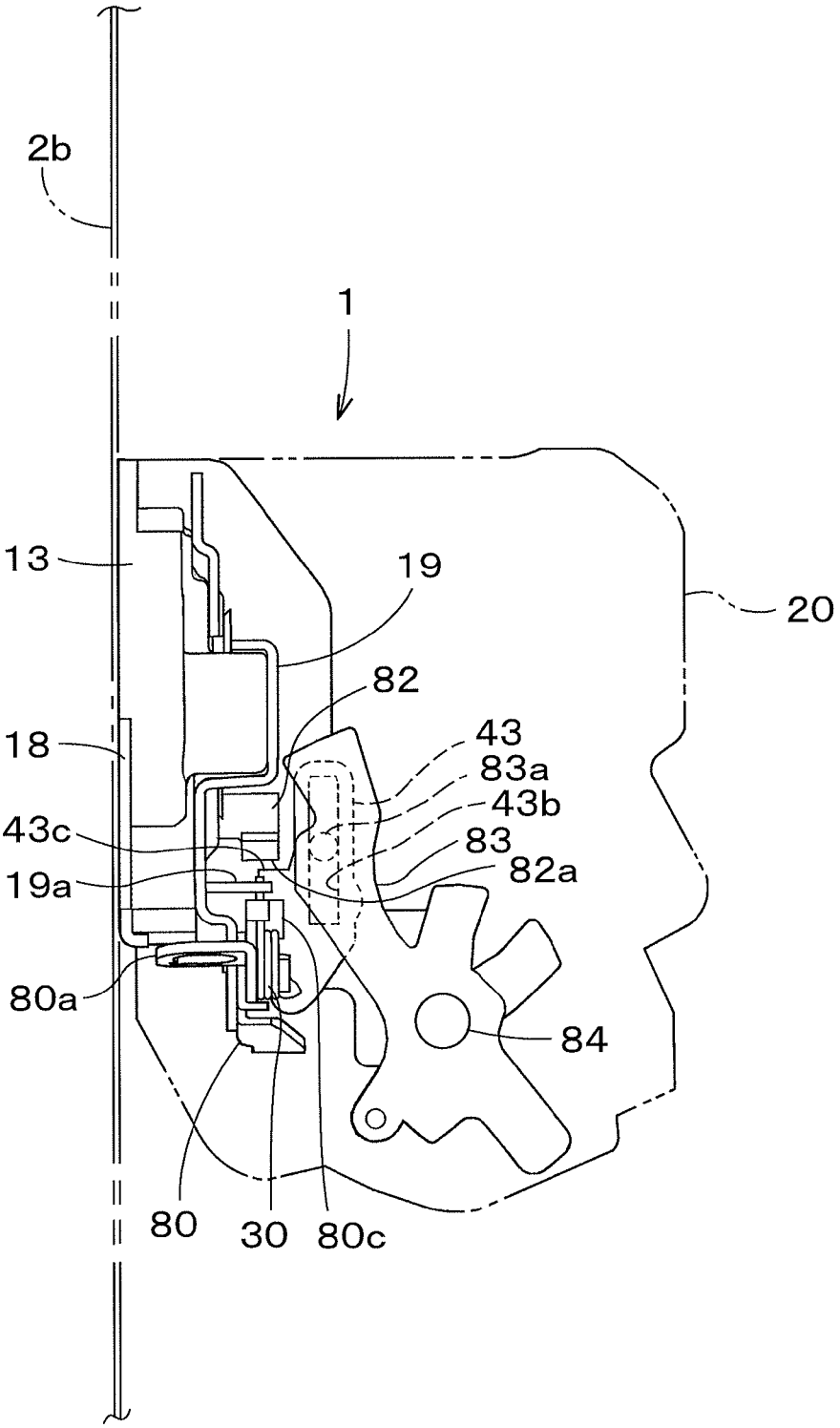
FIG. 41 is a side elevational view of the door latch device in an unlocking state viewed in a direction of an arrow III in FIG. 39.

In FIGS. 40 and 41, the moving elements include a first outside lever 80 outward of the vehicle and a second outside lever 81 inward of the vehicle, pivotally mounted to the back member 19 via a pivot shaft 26 almost in parallel with the outer panel 2*a* or longitudinally of the vehicle; a release lever 43 coupled to the second outside lever 81; an opening lever 82 which turns together with the ratchet 17; an inside lever (not shown) supported by the casing 20 and connected to the inside handle; and a locking lever 83 connected to a lock knob. In this embodiment, the release lever 43 and locking lever 83 correspond to locking means which shifts between a locking state and an unlocking state in this invention. However, the present invention is not limited to this embodiment, but for example, connecting and positional relationships of the release lever 43 and locking lever 83 may be changed. If the locking means can change to an unlocking state which enables the first and second outside levers 80,81 to turn in a releasing direction to enable the door 2 to open and to a locking state which makes it impossible for the first and second outside levers 80,81 to turn in the releasing direction to disable the door 2 to open, any structure may be allowed.

The first outside lever 80 comprises a vehicle-outward connecting portion 80*a* connected to an outside handle 4 which projects from the casing 2 outward of the vehicle, via a motion-transmitting member 3; an elongate hole 80*b*; and a forcing lock portion 80*c* for moving the release lever 43 forcedly from an unlocking position to a locking position. The pivot shaft 26 is put in the elongate hole 80*b* to move inward of the vehicle, and the first outside lever 80 is pivotally mounted to the back member 19 to move inward of the vehicle. The first outside lever 89 is held in a usual position in FIGS. 39, 40, 44 and 45 by a force of a torsion spring 30. When an opening operation of the outside handle 4 is transmitted to the vehicle-outward connecting portion 80*a* via the motion-transmitting member 3, the first outside lever 80 turns in a releasing direction from the usual position to FIG. 46 against the force of the torsion spring 30 at a certain angle (counterclockwise in FIG. 44). If the outer panel 2*a* is deformed inward of the vehicle by impact to come in contact with the connecting portion 80*a*, the outer panel 2*a* is moved against the force of the torsion spring 30 from the usual position to a position where the outer panel 2*a* is dented inward of the vehicle in FIGS. 47 and 48.

In the embodiment, the first outside lever 80 corresponds to detecting means which moves from the usual position inward of the vehicle with deformation of the outer panel 2*a* in this invention. However, the present invention is not limited to this embodiment, and the detecting means may be another element instead of the first outside lever 80. In this case, the first and second outside levers 80,81 may be constructed together, and another element may be added as detecting means.

The second outside lever 81 is pivotally mounted to the back plate 19 via the pivot shaft 26 and comprises an inward coupling portion 81*a* coupled to the lower part of the release lever 43, and a bent portion 81*b* which can come in contact with the first outside lever 80 counterclockwise in FIG. 40.

The torsion spring 30 is wound on the pivot shaft 26 and one end of the torsion spring 30 elastically comes in contact with a contact portion 19*a* of the back member 19 and a contact portion 80*d* of the first outside lever 80 from the inside of the vehicle. The other end of the torsion spring 30 comes in contact with the bent portion 81*b* of the second outside lever 81 clockwise in FIG. 40 thereby applying a clockwise force onto the first and second outside lever 80,81 in FIG. 40 and outward force onto the first outside lever 80. The first and second outside levers 80,81 are prevented from turning from the usual position clockwise in FIG. 40 by a stopper (not shown) of the back member 19 or casing 20.

The motion-transmitting member 3 is moved downward by opening action of the outside handle 4. Thus, the first outside lever 80 turns in a releasing direction from the usual position against a force of the torsion spring 30. The turning is transmitted to the second outside lever 81 via the bent portion 81*b*, and the second outside lever 81 turns together with the first outside lever 80 in the releasing direction.

Figure 42:
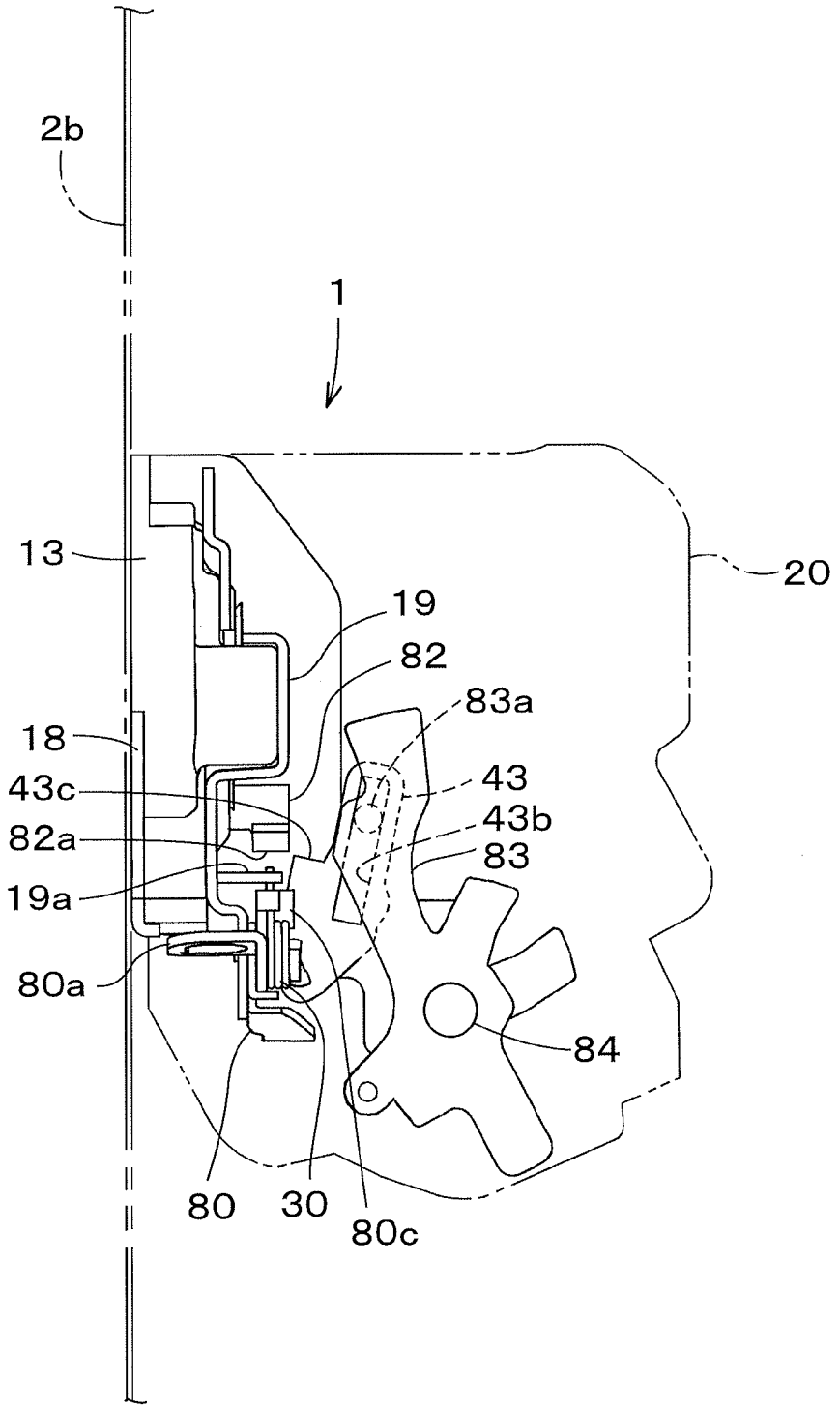
FIG. 42 is a side elevational view of the door latch device in a locking state.
Figure 43:
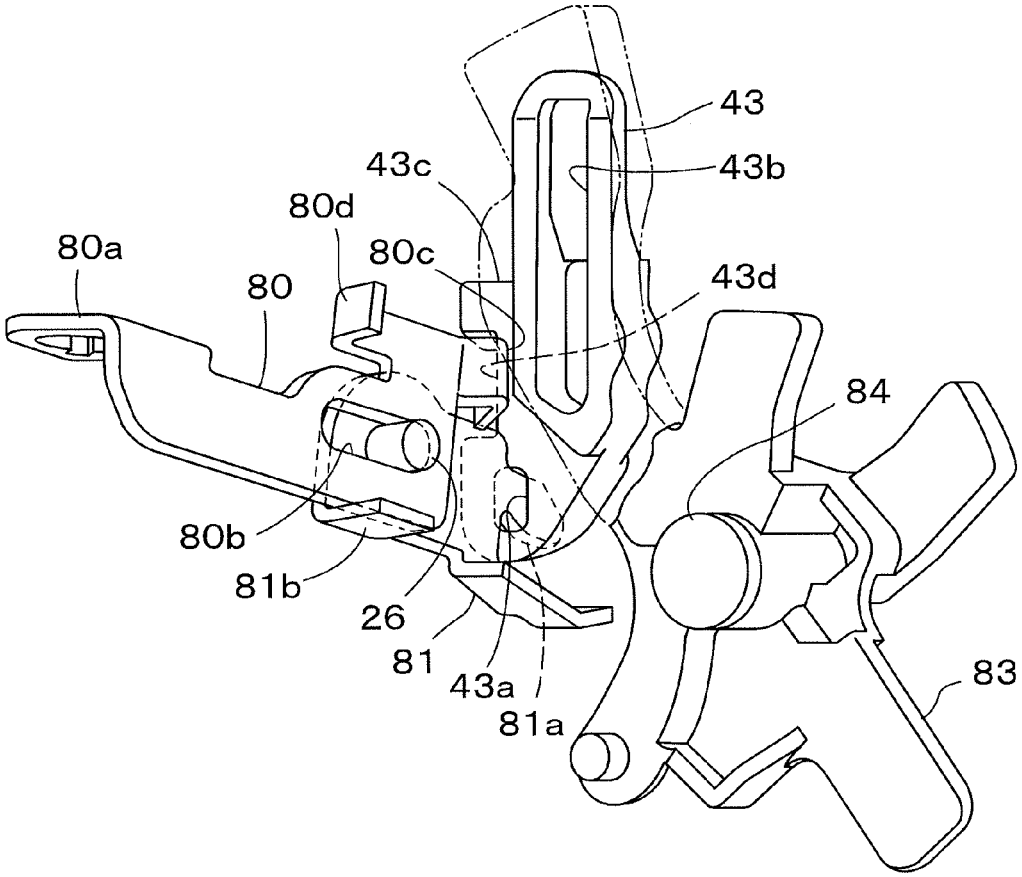
FIG. 43 is a perspective view of a main part of the same.

In FIGS. 41 and 42, the lockling lever 83 is pivotally mounted to the casing 20 via a shaft 84 and connected to a lock knob via a motion-transmitting member such as a Bowden cable. The locking lever 83 can move from an unlocking position in FIG. 41 to a locking position in FIG. 42 turning from FIG. 41 clockwise. The locking lever 83 is elastically held in the locking position and the unlocking position by a force of a spring (not shown).

The connecting portion 81*a* of the second outside lever 81 is inserted into a connecting hole 43*a* of the release lever 43. A projection 83*a* of the locking lever 83 vertically slides along a vertically elongate hole 43*b* of the release lever 43. Thus, the release lever 43 moves with motion of the locking lever 83 to the unlocking and locking positions between an unlocking position in FIG. 41 and a locking position in FIG. 42 to which the release lever 43 turns clockwise at a certain angle from the unlocking position about the connecting portion 81*a*. Above a joining hole 43*a* of the release lever 43, there is formed a forced locking portion 43*d* with which the forcing locking portion 80*c* can come in contact if the first outside lever 60 is concaved.

In FIG. 41, in an unlocking state where the release lever 43 and locking lever 83 are in an unlocking position, turning of the second outside lever 81 in the releasing direction is transmitted to the release lever 43. The release lever 43 moves upward from the usual position, and an disengaging portion 43*c* of the release lever 43 comes in contact with a disengaged portion 82*a* of an opening lever 82 from below to make the opening lever 82 move in a releasing direction or counterclockwise from FIG. 40. The ratchet disengages from the latch 15 to enable the door 2 to open. In FIG. 42, in a locking state where the release lever 43 and locking lever 83 are in the locking position, turning of the second outside lever 81 in a releasing direction from the usual position is transmitted to the release lever 43. Even if the release lever 43 moves obliquely upward from the usual position, the disengaging portion 43*c* of the release lever 43 does not come in contact with the disengaged portion 82*a* of the opening lever 82. Thus, the ratchet 17 still engages with the latch 15, and the door 2 cannot be opened.

Operation of the door latch device 1 in this embodiment, particularly motion of each moving element will be described with respect to FIGS. 44 to 48.

Figure 44:
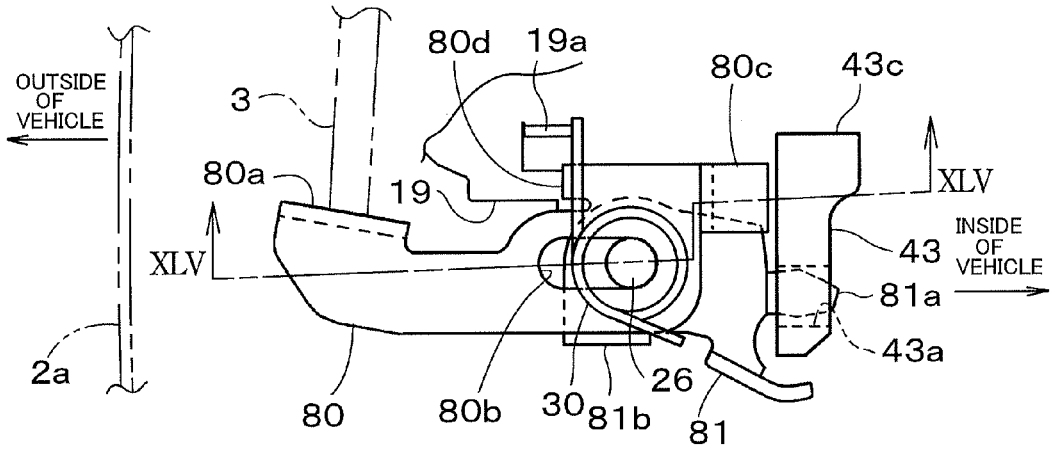
FIG. 44 is a view of the main part in a usual state.
Figure 45:
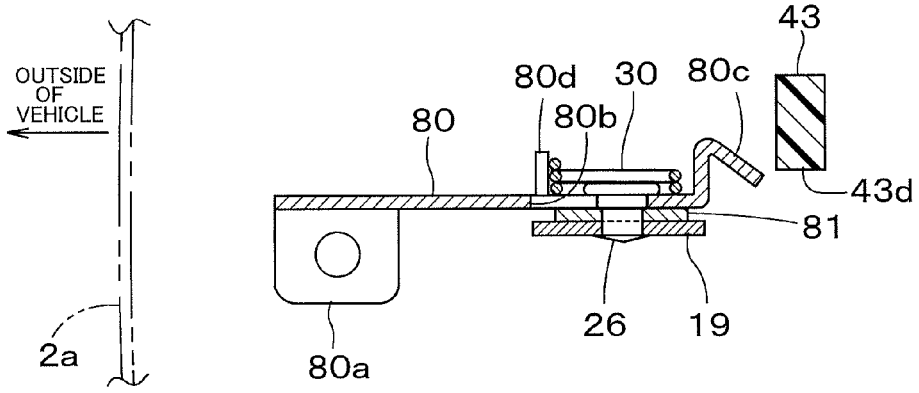
FIG. 45 is a horizontal sectional view taken along the line XLV-XLV in FIG. 44.
Figure 46:
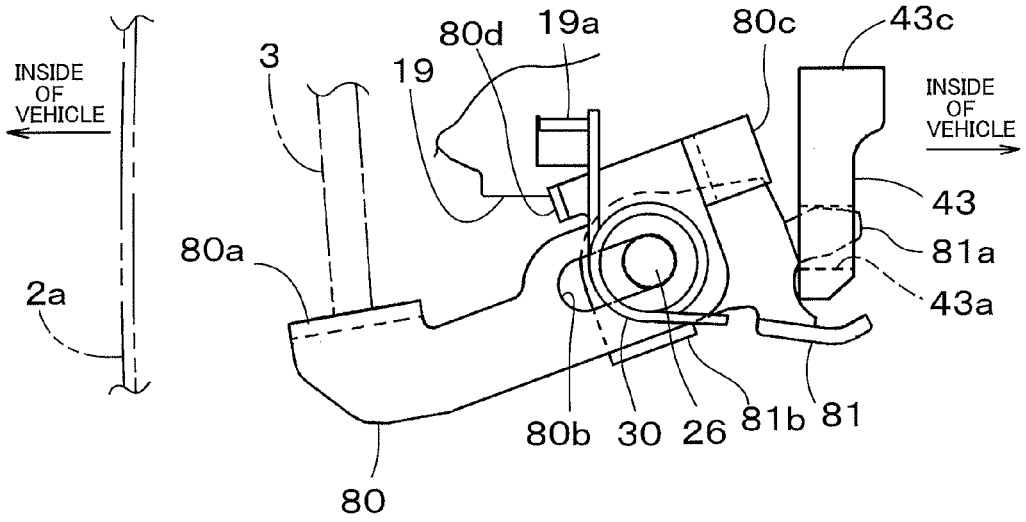
FIG. 46 is view showing operation of the main part when an outside handle is operated to open the door.
Figure 47:
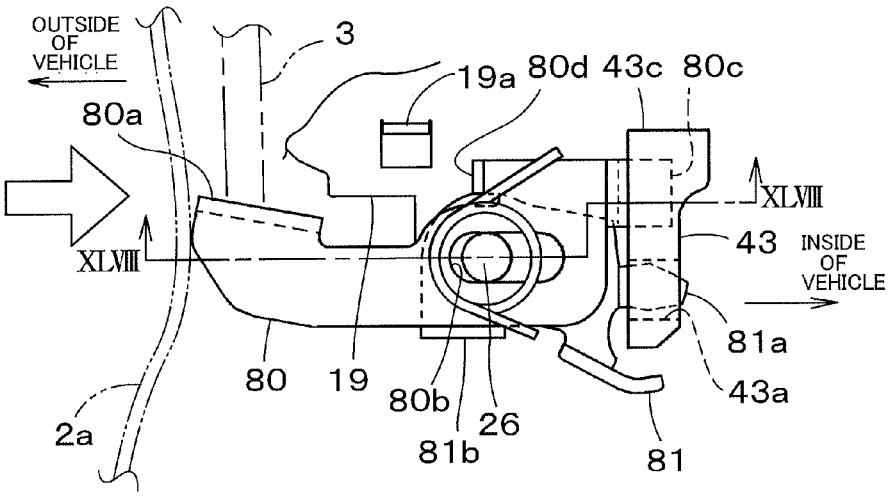
FIG. 47 is a view when an outer panel of a door is deformed inward of a vehicle.
Figure 48:
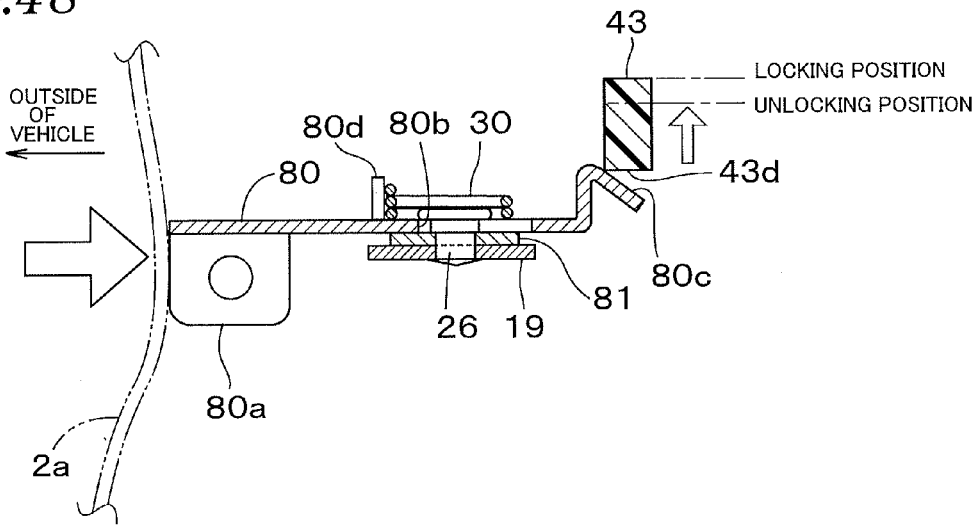
FIG. 48 is a horizontal sectional view taken along the line XLVIII-XLVIII in FIG. 47.

FIGS. 44 and 45 illustrate a usual state where the first and second outside levers 80,81 are held by a force of the torsion spring 30 while the door 2 is closed. In the usual state, the forcing lock portion 80*c* of the first outside lever 80 does not come in contact with the forced portion 43*d* of the release lever 43 beside the release lever 43.

In the usual state and unlocking state, the outside handle 4 is operated to open the door and the motion-transmitting member 3 moves downward. The first and second outside levers 80,81 turn at a certain angle in a releasing direction about the pivot shaft 26 against the force of the torsion spring 30, and turns to a position in FIG. 46 to make the turning transmitted to the release lever 43. The release lever 43 moves upward in a releasing direction, and the disengaging portion 43*c* comes in contact with the disengaged portion 82*a* of the opening lever 82 from below to turn the opening lever 82 in a releasing direction or counterclockwise in FIG. 40. Thus, the ratchet 17 turns together with the opening lever 2 to disengage from the latch 15 to enable the door 2 to open.

In the unlocking state or unlocking state, the outer panel 2*a* is deformed by impact inward of the vehicle, and the deformed outer panel 2*a* comes in contact with the connecting portion 80*a* of the first outside lever 80 to push the first outside lever 80 inward of the vehicle. The first outside lever 80 moves from the usual position inward of the vehicle against the force of the torsion spring 30 to make the forcing lock portion 80*c* contact the forced lock portion 43*d*. Thus, while the forcing lock portion 80*c* moves inward of the vehicle, the release lever 43 is forcedly moved to the locking position. With the movement of the release lever 43 to the locking position, the locking lever 83 also moves to the locking position. If the outer panel is deformed by impact inward of the vehicle and is contacted to the first outside lever 80, locking means such as the release lever 43 and locking lever 83 is shifted from the unlocking state to the locking state.

Even if a force is exerted to move the motion-transmitting member 3 downward or to pivot the first outside lever 80 in a releasing direction with further deformation of the outer panel 2*a*, the opening lever 82 cannot be pivoted because the release lever 43 is placed in a locking position. Thus, it prevents the door 2 from opening accidentally.

The door latch device in the tenth embodiment may be modified or changed as below:

(a) As mentioned above, an outside lever in which the first outside lever 80 is formed together with the second outside lever 81 may be provided. If the outer panel 2 is deformed inward of the vehicle, detecting means that can move from the usual position inward of the vehicle with the deformation may be provided. The forcing locking portion 43*c* for moving the release lever 43 forcedly to a locking position may be provided in the detecting means. In this case, the first outside lever 80 is conventional, and the present invention may be achieved by adding the detecting means.

(b) The forcing locking portion 80*c* may come in contact with the locking lever 83 thereby moving the locking lever 83 and release lever 43 to a locking position.

(c) The door may be a sliding door or a tailgate in the vehicle.

What is claimed is:

1. A vehicle door latch device positioned in a vehicle body of a vehicle, the vehicle body having a striker, the vehicle door latch device comprising:

a base member fixed in a door of the vehicle;

a back member;

an engagement portion configured to engage with the striker of the vehicle body of the vehicle;

a pivot shaft;

a first outside lever pivotally mounted to the base member via the pivot shaft;

a motion-transmitting member coupled to an outside handle on an outer panel of the door;

a second outside lever comprising an engagement projection and an elongate hole, wherein the second outside lever is pivotally mounted on the pivot shaft through the elongate hole such that the elongate hole extends transversely relative to the vehicle and an inner end of the elongate hole is in contact with the pivot shaft during usual operation of the vehicle door latch device so as to allow the second outside lever to move toward an inside of the vehicle in the event of a crash, an outer end of the second outside lever being connected to an outside handle via the motion-transmitting member so that the second outside lever turns in a releasing direction for disengaging the engagement portion from the striker with operation of the outside handle during usual operation of the vehicle door latch device;

a torsion spring mounted to the base member so as to surround the pivot shaft and comprising two arms, wherein a first arm of the two arms engages with the first outside lever so as to bias the first outside lever and the second outside lever such that the engagement projection of the second outside lever is in contact with the first outside lever, and a second arm of the two arms engages with the base member and the engagement projection of the second outside lever to bias the engagement projection of the second outside lever into contact with the first outside lever;

a release lever connected to an inner end of the first outside lever and configured to disengage the engagement portion from the striker when the outside handle is operated during usual operation of the vehicle door latch device; and a bolt that passes through the pivot shaft to firmly connect the back member to the base member, wherein, during usual operation of the vehicle door latch device, a rotation of the second outside lever in the releasing direction is transmitted to the first outside lever such that the engagement portion is disengaged from the striker by the release lever, and when an external force from a crash is applied to the second outside lever, the second outside lever moves toward the inside of the vehicle along a width of the vehicle against a force of the torsion spring until an outer end of the elongate hole, opposite to the inner end, comes in contact with the pivot shaft to enable the engagement projection of the second outside lever to come out of contact with the first outside lever, thereby preventing a rotation of the second outside lever in the releasing direction from being transmitted to the first outside lever.

2. The vehicle door latch device of claim 1, wherein the engagement portion comprises:

a latch configured to engage with the striker of the vehicle body; and a ratchet configured to engage with the latch to prevent disengagement of the latch from the striker.

* * * * *